US010828685B2

(12) United States Patent
Miyagi et al.

(10) Patent No.: US 10,828,685 B2
(45) Date of Patent: Nov. 10, 2020

(54) BLANK, AND PRESSED ARTICLE MANUFACTURING METHOD

(71) Applicant: NIPPON STEEL & SUMITOMO METAL CORPORATION, Tokyo (JP)

(72) Inventors: Takashi Miyagi, Tokyo (JP); Yasuharu Tanaka, Tokyo (JP); Misao Ogawa, Tokyo (JP); Toshimitsu Aso, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 835 days.

(21) Appl. No.: 15/310,249

(22) PCT Filed: May 8, 2015

(86) PCT No.: PCT/JP2015/063385
§ 371 (c)(1),
(2) Date: Nov. 10, 2016

(87) PCT Pub. No.: WO2015/174353
PCT Pub. Date: Nov. 19, 2015

(65) Prior Publication Data

US 2017/0151597 A1 Jun. 1, 2017

(30) Foreign Application Priority Data

May 14, 2014 (JP) ..... 2014-100619
Oct. 1, 2014 (JP) ..... 2014-203316

(51) Int. Cl.
*B21D 22/02* (2006.01)
*B21D 22/21* (2006.01)
(Continued)

(52) U.S. Cl.
CPC ..... *B21D 22/02* (2013.01); *B21D 22/21* (2013.01); *B21D 22/26* (2013.01); *B21D 47/00* (2013.01); *B21D 53/88* (2013.01)

(58) Field of Classification Search
CPC ..... B21D 22/02; B21D 22/21; B21D 22/26; B21D 47/00; B21D 53/88
(Continued)

(56) References Cited

U.S. PATENT DOCUMENTS

2005/0262917 A1 12/2005 Osumi et al.
2012/0297853 A1 11/2012 Tanaka et al.
2015/0273563 A1 10/2015 Miyagi et al.

FOREIGN PATENT DOCUMENTS

JP 7-290159 A 11/1995
JP 2551022 B2 11/1996
(Continued)

OTHER PUBLICATIONS

Takashi et al., WO 2014/050973 A1, machine translation, Apr. 3, 2014, entire machine translation (Year: 2014).*
(Continued)

*Primary Examiner* — Humera N. Sheikh
*Assistant Examiner* — Katherine A Christy
(74) *Attorney, Agent, or Firm* — Birch, Stewart, Kolasch & Birch, LLP

(57) ABSTRACT

A blank for forming a pressed article, the blank including a flat pattern edge configuring an edge on one length direction side of the blank, and an excess portion formed at the flat pattern edge. An edge of the excess portion includes a first convex portion that protrudes toward the one length direction side of the blank with respect to the flat pattern edge, a first concave portion that is adjacent to the first convex portion at a width direction outer side of the blank, that is formed in a concave shape, and that connects the flat pattern
(Continued)

edge and the first convex portion together, and a second concave portion that is adjacent to the first convex portion at a width direction inner side of the blank, that is formed in a concave shape, and that connects the flat pattern edge and the first convex portion together.

6 Claims, 21 Drawing Sheets

(51) Int. Cl.
*B21D 22/26* (2006.01)
*B21D 47/00* (2006.01)
*B21D 53/88* (2006.01)

(58) Field of Classification Search
USPC ..... 428/542.8
See application file for complete search history.

(56) References Cited

FOREIGN PATENT DOCUMENTS

| | | | | |
|---|---|---|---|---|
| JP | 2003-103306 | A | 4/2003 | |
| JP | 2004-154859 | A | 6/2004 | |
| JP | 2006-15404 | A | 1/2006 | |
| JP | 2008-307557 | A | 12/2008 | |
| KR | 10-2012-0140236 | A | 12/2012 | |
| WO | WO 2011/145679 | A1 | 11/2011 | |
| WO | WO-2012070623 | A1 * | 5/2012 | ..... B21D 22/26 |
| WO | WO 2014/050973 | A1 | 4/2014 | |

OTHER PUBLICATIONS

Takatoshi, WO 2012/070623 A1, machine translation, May 31, 2012, entire machine translation (Year: 2012).*

Indian Office Action for corresponding Indian Application No. 201617038554, dated Sep. 4, 2019, with English tranlsation.

Office Action dated Nov. 2, 2017, in Candian Patent Application No. 2,948,791.

International Search Report for PCT/JP2015/063385 dated Jul. 21, 2015.

Written Opinion of the International Searching Authority for PCT/JP2015/063385 (PCT/ISA/237) dated Jul. 21, 2015.

Office Action dated Feb. 5, 2018, in Korean Patent Application No. 10-2016-7031724,with English translation.

* cited by examiner

BLANK, AND PRESSED ARTICLE MANUFACTURING METHOD

TECHNICAL FIELD

The present invention relates to a blank, and a manufacturing method for a pressed article that employs the blank.

BACKGROUND ART

Automotive body shells include unit construction structures (monocoque structures) in which framework members such as front pillars, center pillars, side sills, roof rails, side members, and the like are joined together with various formed panels such as hood ridges, dash panels, front floor panels, rear floor front panels, and rear floor rear panels. Framework members that generally have a closed cross-section, such as front pillars, center pillars, and side sills, are assembled by joining configuration members such as front pillar reinforcement, center pillar reinforcement, and side sill outer reinforcement, to other configuration members such as outer panels and inner panels.

FIG. 19 is an explanatory diagram illustrating an example of a framework member 1 formed by joining configuration members 2, 3, 4, and 5 together by spot welding. As illustrated in FIG. 19, the configuration member 2 has a substantially hat-shaped lateral cross-section profile including a top plate 2*a*, a pair of left and right vertical walls 2*b*, 2*b*, and flanges 2*c*, 2*c* linked to the vertical walls 2*b*, 2*b*. The top plate 2*a* has a T-shaped outer profile in plan view (components with such an outer profile are also referred to as "T-shaped profile components" below), thereby securing the strength and rigidity of the framework member 1.

FIG. 20 is an explanatory diagram illustrating a T-shaped profile component 2 including a top plate with a T-shaped outer profile in plan view. As illustrated in FIG. 20, the T-shaped profile component 2 is configured including a first formed section 12 extending in a length direction, and a second formed section 14 configuring one length direction end portion of the T-shaped profile component 2. Moreover, in the T-shaped profile component 2, a width dimension of the top plate in the second formed section 14 is set larger than a width dimension of the top plate in the first formed section 12, and a length direction end portion of the second formed section 14 is formed with a T-shape in plan view. Note that as modifications of the T-shaped profile component 2, there are also Y-shaped profile components (not illustrated in the drawings) in which the top plate has a Y-shaped outer profile in plan view, and L-shaped profile components (not illustrated in the drawings) in which the top plate has an L-shaped outer profile in plan view.

Pressing that employs drawing is employed in order to suppress creasing from occurring when manufacturing the T-shaped profile component 2, Y-shaped profile components, or L-shaped profile components by pressing.

However, in order to manufacture a pressed article by pressing employing drawing, a wide trim region is inevitably required at the periphery of an intermediate pressed article, thereby reducing the yield of the pressed article, and increasing the manufacturing cost.

In order to prevent the occurrence of creasing and cracking in pressed articles, conventionally, metal sheets having excellent ductility but comparatively low strength have been employed in blanks for T-shaped profile components such as center pillar reinforcement. It is accordingly necessary to increase the sheet thickness of the blank in order to secure strength, making an increase in weight and an increase in cost unavoidable.

Methods for pressing by bending to manufacture components with simple cross-section profiles such as hat shapes or Z-shapes running along the entire length direction are, for example, described in Japanese Patent Application Laid-Open (JP-A) Nos. 2003-103306, 2004-154859, 2006-015404, and 2008-307557. However, none of these methods can be applied when manufacturing components with complex shapes, such as T-shaped profile components, Y-shaped profile components, or L-shaped profile components.

Recently, high tensile sheet steel is being employed in framework members in order to reduce weight and increase strength. High tensile sheet steel has lower ductility than general sheet steel, and so there is demand for methods to suppress the occurrence of creases, cracking, and the like during pressing. The pamphlet of International Publication (WO) No. 2011/145679 describes a manufacturing method (free bending method) for a pressed article enabling T-shaped profile components, Y-shaped profile components, and L-shaped profile components to be manufactured while suppressing the occurrence of creases, cracking, and the like, even when employing a blank configured by high tensile sheet steel with low ductility.

In this pressed article manufacturing method (free bending method), a T-shaped component 2 is manufactured by causing the top plate 2*a* of the second formed section 14 to move in-plane (slide) inside the mold when forming the vertical walls 2*b* and the flanges 2*c* of the second formed section 14.

However, even in the above free bending method, if a width dimension of the top plate 2*a* of the second formed section 14 is large, sometimes cracking can occur due to a reduction in sheet thickness of the blank becoming large. Specifically, new issues particular to free bending methods have emerged, namely cracking occurring at portions of the second formed section 14 linking from the vertical walls 2*b* to the flanges 2*c* (region A in FIG. 20) (this cracking is referred to below as "flange cracking"), and cracking occurring at an edge at one length direction end of the top plate 2*a* of the second formed section 14 (region B in FIG. 20) (this cracking is referred to below as "top plate edge cracking").

As a countermeasure, in WO No. 2014/050973, excess portions forming bulges toward the length direction outer side are provided to edges at both length direction ends of a blank in order to avoid top plate edge cracking (see paragraph 0035 and FIG. 3 of WO No. 2014/050973). Specifically, the excess portions form bulges projecting toward the length direction outer side with respect to edges at both length direction ends of the blank.

SUMMARY OF INVENTION

Technical Problem

However, even in blanks with excess portions provided to the edges, there is still room for improvement in the following regard. Namely, at both length direction ends of the blank, portions of the edges adjacent to the excess portions on both sides in the width direction (referred to below as "adjacent edges" for convenience) are formed in substantially straight line shapes. In other words, the substantially straight line shaped adjacent edges and the curved excess portions intersect with each other at boundary portions between the adjacent edges and the excess portions. Accordingly, even when the T-shaped profile component 2 is manufactured using the free bending method employing the blank described in WO No. 2014-050973, if the width dimension of the top plate 2*a* of the second formed section 14 of the T-shaped profile component 2 is large, a reduction in sheet thickness at the boundary portions between the adjacent edges and the excess portions becomes large, and there is a possibility of top plate edge cracking occurring at these boundary portions.

The present invention relates to obtaining a blank and a pressed article manufacturing method capable of suppressing top plate edge cracking.

Solution to Problem

A blank of the present disclosure is a blank for forming a pressed article that includes a top plate formed in an elongated shape with a length direction along a first direction and including a pair of outer edges extending along the length direction in plan view, the top plate being laid out with at least one of the outer edges curving so as to extend out toward a width direction outer side at an end portion on one length direction side of the top plate so that the one outer edge is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view. The blank includes a flat pattern edge configuring an edge on the one length direction side of the blank, and an excess portion formed at the flat pattern edge. An edge of the excess portion includes a first convex portion that protrudes toward the one length direction side of the blank with respect to the flat pattern edge, a first concave portion that is adjacent to the first convex portion at a width direction outer side of the blank, that is formed in a concave shape opening toward the one length direction side of the blank, and that connects the flat pattern edge and the first convex portion together, and a second concave portion that is adjacent to the first convex portion at a width direction inner side of the blank, that is formed in a concave shape opening toward the one length direction side of the blank, and that connects the flat pattern edge and the first convex portion together.

According to the blank addressing the above issue, the blank is configured as a blank for the pressed article including the top plate, the pair of vertical walls, and the pair of flanges. The top plate of the pressed article is formed in an elongated shape with its length direction along the first direction. Moreover, the top plate includes the pair of outer edges extending along the length direction in plan view. At least one of the outer edges is laid out curving toward the width direction outer side at the end portion on the one length direction side of the top plate so as to be separated toward the other length direction side from the edge on the one length direction side. One length direction side end portion of the pressed article is thereby formed with a T-shaped profile or an L-shaped profile in plan view, and the pressed article is configured as a T-shaped profile component or an L-shaped profile component.

In the pressed article, the pair of vertical walls extend out from the pair of outer edges of the top plate toward the lower side, and the pair of flanges extend out from lower end portions of the respective vertical walls toward the opposite sides to the top plate in plan view. The pressed article is thereby formed with a hat shape opening toward the lower side as viewed from the other length direction side.

The blank includes the flat pattern edge configuring an edge on the one length direction side of the blank, and the excess portion formed at the flat pattern edge.

The edge of the excess portion includes the first convex portion that protrudes toward the one length direction side of the blank with respect to the flat pattern edge. The flat pattern edge is accordingly configured so as to be thickened toward the one length direction side by the excess portion. Accordingly, during the forming process of the pressed article, a reduction in sheet thickness at the edge of the blank on the one length direction side (namely, the flat pattern edge and the edge of the excess portion) can be suppressed even when the flat pattern edge and the edge of the excess portion move in-plane (slide) inside the mold.

Moreover, the edge of the excess portion includes the first concave portion that is adjacent to the first convex portion at the width direction outer side of the blank, and the second concave portion that is adjacent to the first convex portion at the width direction inner side of the blank. The first concave portion and the second concave portion are each formed in concave shapes opening toward the one length direction side of the pressed article, and connect the flat pattern edge and the first convex portion together. Boundary portions between the first convex portion and the flat pattern edge can accordingly be connected smoothly by the first concave portion and the second concave portion. This thereby enables a localized reduction in sheet thickness at the boundary portions between the first convex portion and the flat pattern edge of the blank to be suppressed, and enables top plate edge cracking at the boundary portions to be suppressed.

Advantageous Effects of Invention

The blank of the present disclosure has the excellent advantageous effect of enabling top plate edge cracking to be suppressed.

DESCRIPTION OF EMBODIMENTS

First Exemplary Embodiment

First, explanation follows regarding a pressed article 20 manufactured using a blank 30 according to a first exemplary embodiment. Explanation will then be given regarding a mold unit 40 employed when forming the pressed article 20, followed by explanation regarding the blank 30. In the following explanation, an example is described in which the pressed article 20 is configured as a T-shaped profile component. The blank 30 that is the stock material for the pressed article 20 is not limited to a specific material, as long as it is a metal sheet suited for pressing. The blank 30 is preferably a sheet metal suited for pressing, such as sheet steel, sheet aluminum, or a sheet of an alloy with steel or aluminum as a main component. In the present exemplary embodiment, explanation is given regarding a case in which the blank 30 is sheet steel.

Pressed Article 20

The stock material for the pressed article 20 is the blank 30, described later, or a forming sheet resulting from preprocessing the blank 30. The pressed article 20 is obtained by pressing using a pressing method (free bending method) described later, using the mold unit 40, described later.

Figure 1:
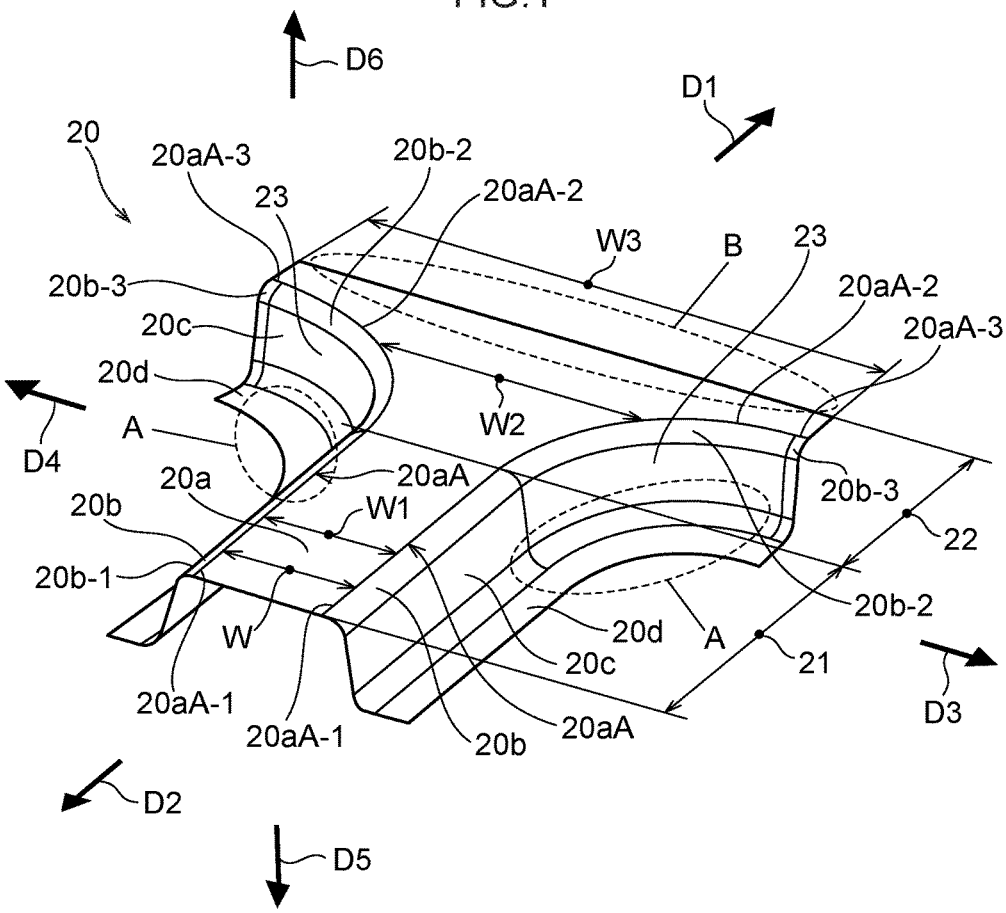
FIG. 1 is a perspective view schematically illustrating a pressed article formed employing a blank according to a first exemplary embodiment.

As illustrated in FIG. 1, the pressed article 20 is formed in an elongated shape with its length direction along a first direction (the arrow D1 direction and the arrow D2 direction in FIG. 1). Note that the arrow D1 and the arrow D2, illustrated as appropriate in the drawings, indicate the length direction of the pressed article 20. Moreover, the arrow D1 indicates one length direction side of the pressed article 20, and the arrow D2 indicates the other length direction side of the pressed article 20. The arrow D3 and the arrow D4, illustrated as appropriate in the drawings, indicate a width direction of the pressed article 20, this being orthogonal to the length direction of the pressed article 20 in plan view. In the following explanation, unless specifically indicated otherwise, reference in the explanation simply to the length direction and the width direction refers to the length direction and the width direction of the pressed article 20.

An end portion at one length direction side of the pressed article 20 projects out toward the width direction outer sides (the arrow D3 direction and the arrow D4 direction in FIG. 1) so as to form a substantially T-shape, and the pressed article 20 has left-right symmetry about a width direction center line (not illustrated in the drawings). The pressed article 20 is configured including a first formed section 21 extending along the length direction, and a second formed section 22 configuring an end section on one length direction side of the pressed article 20, and adjacent to the first formed section 21 on the one length direction side. Note that the width direction outer sides of the pressed article 20 refer to sides in directions heading away from each other with respect to the width direction center line (not illustrated in the drawings) of the first formed section 21. Width direction inner sides of the pressed article 20 refer to sides in directions approaching each other with respect to the width direction center line of the first formed section 21.

As viewed from the length direction other side, the pressed article 20 is formed with a substantially hat shaped cross-section profile opening toward the lower side (the arrow D5 side in FIG. 1). The pressed article 20 is thus configured including a top plate 20*a*, a pair of ridge lines 20*b*, a pair of vertical walls 20*c*, and a pair of flanges 20*d*. These will be described in detail below.

The top plate 20*a* is formed in a substantially T-shaped plate shape in plan view as viewed from the upper side (the side of arrow D6 in FIG. 1). Specifically, the top plate 20*a* includes a pair of outer edges 20*a*A extending along the length direction. Portions of the outer edges 20*a*A corresponding to the first formed section 21 configure first outer edges 20*a*A-1, and the pair of first outer edges 20*a*A-1 are disposed substantially parallel to each other along the length direction. The portion of the top plate 20*a* corresponding to the first formed section 21 is accordingly set with a substantially uniform width W1.

Portions of the outer edges 20*a*A that correspond to the second formed section 22 and that are portions adjacent to the first outer edges 20*a*A-1 configure second outer edges 20*a*A-2. The second outer edges 20*a*A-2 extend out from one length direction ends of the respective first outer edges 20*a*A-1 toward the width direction outer sides. Specifically, the second outer edges 20*a*A-2 are curved into arc shapes protruding toward the one length direction side and the width direction inner side of the pressed article 20 in plan view. Accordingly, at a portion of the top plate 20*a* corresponding to the second formed section 22 and adjacent to the first formed section 21, a width W2 of the top plate 20*a* is set so as to become larger (wider) on progression toward the one length direction side of the pressed article 20. Moreover, the second outer edges 20*a*A-2 are disposed so as to be separated toward the other length direction side from an edge on the one length direction side of the top plate 20*a*.

The outer edges 20*a*A further include third outer edges 20*a*A-3. The third outer edges 20*a*A-3 extend out from width direction outer side ends of the respective second outer edges 20*a*A-2 toward the width direction outer side of the pressed article 20. Note that the third outer edges 20*a*A-3 may be omitted from the outer edges 20*a*A.

The pair of vertical walls 20*c* respectively extend out toward the lower side from the first outer edges 20*a*A-1, the second outer edges 20*a*A-2, and the third outer edges 20*a*A-3 of the top plate 20*a*, with the ridge lines 20*b* interposed therebetween. The vertical walls 20*c* accordingly extend so as to follow the first outer edges 20*a*A-1, the second outer edges 20*a*A-2, and the third outer edges 20*a*A-3, and the vertical walls 20*c* curve in arc shapes in plan view where connected to the second outer edges 20*a*A-2. Namely, the pair of vertical walls 20*c* are not formed at the one length direction side edge of the top plate 20*a*, nor at width direction outer side edges of the top plate 20*a* at the second formed section 22, and are disposed so as to be separated toward the other length direction side from the one length direction side edge of the top plate 20*a*.

The pair of flanges 20*d* respectively extend out from leading edges (lower edges) of the vertical walls 20*c* toward the opposite side from the top plate 20*a* in plan view, and are disposed substantially parallel to the top plate 20*a*. Accordingly, in plan view, the flanges 20*d* also extend so as to follow the first outer edges 20*a*A-1, the second outer edges 20*a*A-2, and the third outer edges 20*a*A-3, and where they are connected to the second outer edges 20*a*A-2 through the vertical walls 20*c*, the respective flanges 20*d* are curved in arc shapes in plan view.

The ridge lines 20*b* are formed at boundary portions between the top plate 20*a* and the vertical walls 20*c*. Where they correspond to the first outer edges 20*a*A-1, the ridge lines 20*b* configure first ridge lines 20*b*-1, where they correspond to the second outer edges 20*a*A-2, the ridge lines 20*b* configure second ridge lines 20*b*-2, and where they correspond to the third outer edges 20*a*A-3, the ridge lines 20*b* configure third ridge lines 20*b*-3. The locations of the vertical walls 20*c* and the flanges 20*d* that are connected to the curved second ridge lines 20*b*-2 are collectively referred to as curved portions 23.

Note that as viewed from the upper side of the top plate 20*a*, the respective second ridge lines 20*b*-2 (second outer edges 20*a*A-2) may have a shape with uniform curvature, an elliptical arc shape, or a shape including plural curvatures. Namely, in plan view, in the pressed article 20, the top plate 20*a* is present at a radial direction outer side of the arc shaped curved second ridge lines 20*b*-2, and the flanges 20*d* are present at the radial direction inner side of the second ridge lines 20*b*-2 (on the side toward the center of curvature of the arc). Moreover, the top plate 20*a* need not be perfectly flat, and the top plate 20*a* may be applied with various additional shapes (such as recesses or protrusions) according to the design of the pressed component or the like.

Figure 3:
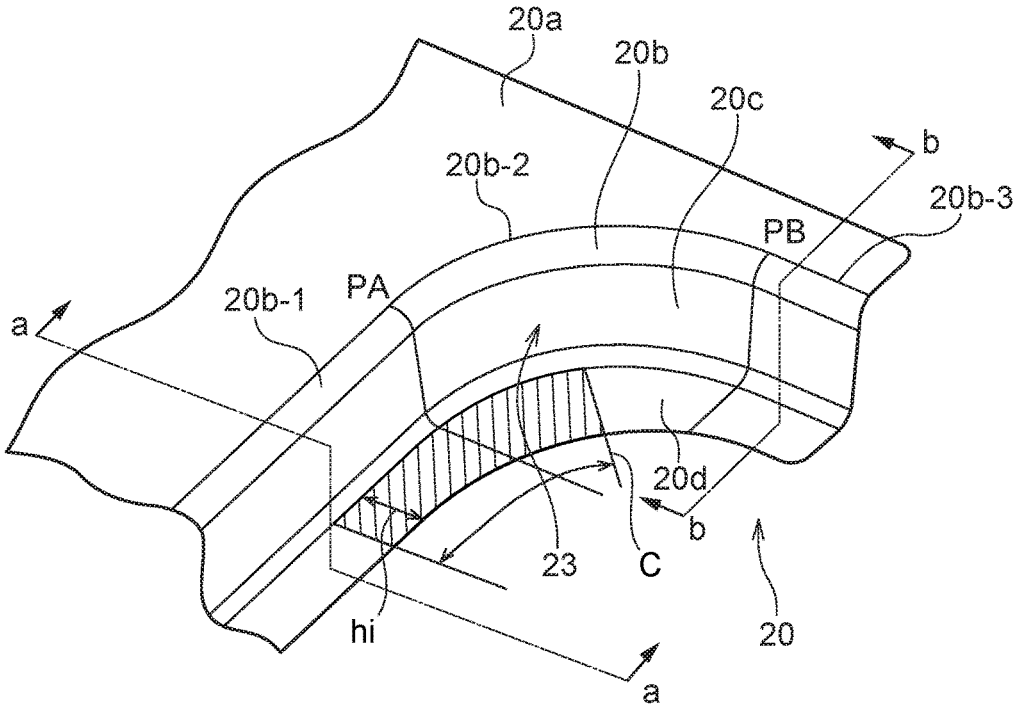
FIG. 3 is an enlarged perspective view illustrating a portion on one width direction side of the pressed article illustrated in FIG. 1.

As illustrated in FIG. 3, a base end portion of each of the second ridge lines 20*b*-2 of the pressed article 20 (an end portion adjacent to the first ridge line 20*b*-1, an end portion at a position further in the length direction from a blank edge 30*a* on the one length direction side of the blank 30, described later) configures an end portion PA (a first end portion). A terminal end portion of each second ridge line 20*b*-2 (an end portion adjacent to the third ridge line 20*b*-3) configures an end portion PB (a second end portion). In plan view, the first ridge line 20*b*-1 is connected to the second ridge line 20*b*-2 so as to meet the second ridge line 20*b*-2 at the end portion PA. The third ridge line 20*b*-3 extends out from the end portion PB toward the width direction outer side.

Figure 2:
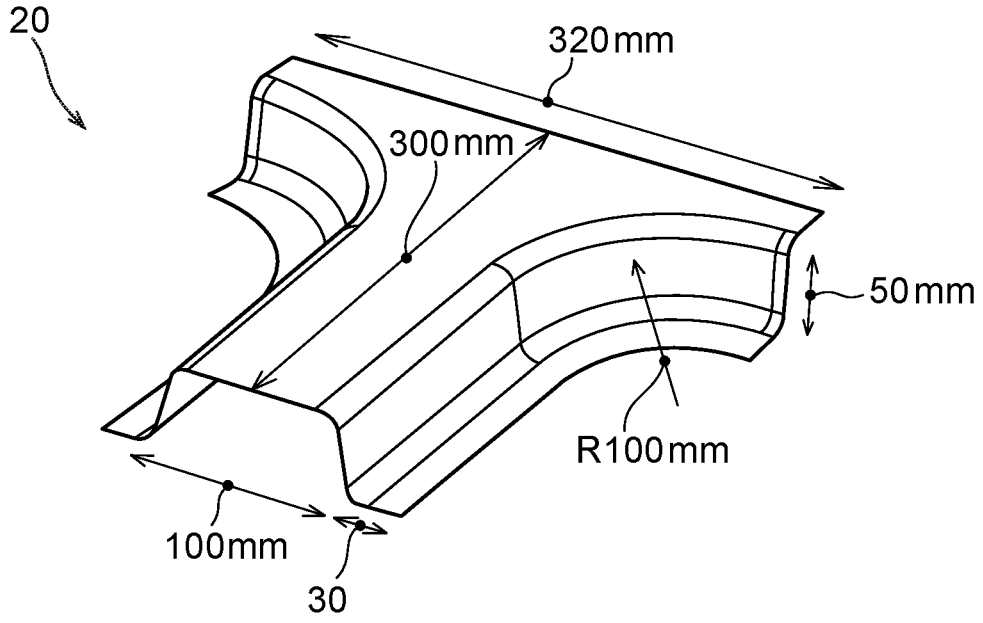
FIG. 2 is an explanatory diagram illustrating an example of dimensions of relevant portions of the pressed article illustrated in FIG. 1.

Next, explanation follows regarding dimensions of the pressed article 20, with reference to FIG. 2. A length direction dimension of the pressed article 20 is set within a range of from 100 mm to 1600 mm (for example, 300 mm in the present exemplary embodiment). A width W1 of the top plate 20*a* at the first formed section 21 is set in a range of from 50 mm to 200 mm (for example, 100 mm in the present exemplary embodiment). A width W3 of the top plate 20*a* at one length direction side end portion of the pressed article 20 is set in a range of from 70 mm to 2000 mm (for example, 320 mm in the present exemplary embodiment).

The height of the pair of vertical walls 20*c* is set in a range of from 20 mm to 120 mm (for example, 50 mm in the present exemplary embodiment). Note that there is a tendency for creases to form more readily in the vertical walls 20*c* if the height of the vertical walls 20*c* is set to less than 0.2 times the peripheral length of the arc shaped curved second ridge lines 20*b*-2, or if set to less than 20 mm. Accordingly, the height of the vertical walls 20*c* is preferably 0.2 times or greater the peripheral length of the second ridge lines 20*b*-2, or 20 mm or greater.

Moreover, the radii of curvature of the curved portions of the vertical walls 20*c* are set in a range of from 5 mm to 500 mm (100 mm in the present exemplary embodiment). If the radius of curvature of the maximum curvature portion were to be less than 5 mm, the periphery of the maximum curvature portion would jut out locally and therefore tend to be more vulnerable to cracking. Conversely, if the radius of curvature of the maximum curvature portion were to exceed 500 mm, a length obtained by subtracting the width W1 of the first formed section 21 from the width W3 of the top plate 20*a* at the one length direction side end portion of the pressed article 20 would become long. Accordingly, the pulling in distance toward the vertical walls 20*c* during the pressing process would become longer, increasing the distance of sliding between the mold unit 40 and the blank 30, described later, exacerbating abrasion of the mold unit 40, and shortening the life of the mold. It is accordingly preferable for the radius of curvature of the maximum curvature portion to be 300 mm or less.

Moreover, the widths of the pair of flanges 20*d* are both set within a range of from 10 mm to 100 mm (for example 30 mm in the present exemplary embodiment). Moreover, as illustrated in FIG. 3, it is sufficient that a width hi of the flanges 20*d* at a side further to the end portion PA side than a peripheral direction (extension direction) center line C of the curved flanges 20*d* is from 25 mm to 100 mm.

More specifically, during pressing, described later, pressing is preferably performed such that the width hi of each of the flanges 20*d* is from 25 mm to 100 mm in a region spanning from the center line C and past the end portion PA as far as a position 50 mm away from the end portion PA on the other length direction side (see the hatched region in FIG. 3). Namely, if locations are present in the above region where the width hi is less than 25 mm, there is a large reduction in sheet thickness of the flange 20*d* during pressing, and cracking is liable to occur. This is due to force pulling in the one length direction end portion of the top plate 20*a* at the second formed section 22 (in the vicinity of region B in FIG. 1) toward the vertical wall 20*c* side being concentrated in the proximity of the flange 20*d* during the pressing process.

Conversely, if locations are present in the above region where the width hi exceeds 100 mm, a peripheral direction (extension direction) compression amount of the flange 20*d* becomes large, and creasing of the flange 20*d* is liable to occur. Accordingly, setting the width hi of the above region to from 25 mm to 100 mm enables the occurrence of creasing and cracking of the flange 20*d* to be suppressed.

Note that the width hi of the flange 20*d* is defined as the length of the flange 20*d* in a direction orthogonal to a tangent to any given position along the edge of the flange 20*d*. Moreover, in cases in which a manufactured component has a shape in which the width hi of the flanges 20*d* is less than 25 mm, preferably an intermediate pressed body in which the flanges 20*d* have a width of 25 mm or greater is manufactured by pressing, after which the unwanted portions are cut away.

Mold Unit 40

Figure 7:
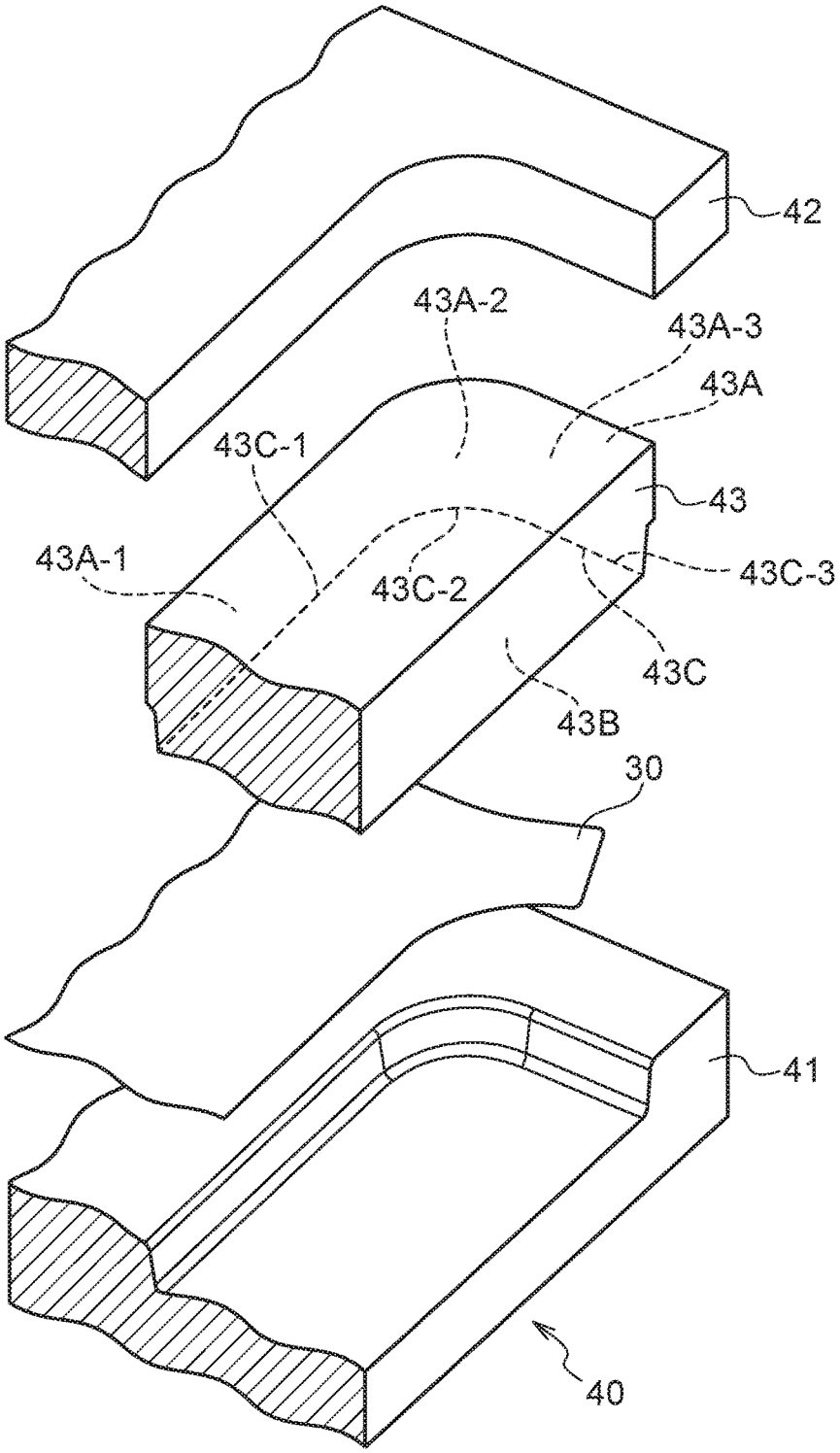
FIG. 7 is an explanatory diagram schematically illustrating a mold unit employed in manufacture of the pressed article illustrated in FIG. 1, in an exploded state.

Next, explanation follows regarding the mold unit 40, serving as a "mold" for manufacturing the pressed article 20, with reference to FIG. 7. Note that FIG. 7 illustrates the mold unit 40 corresponding to a portion on one width direction side of the pressed article 20, and illustration of the mold unit 40 corresponding to a portion on the other width direction side of the pressed article 20 is omitted. As illustrated in FIG. 7, the mold unit 40 is configured including a die 41, a pad 42, and a pair of bending molds 43 (only one of the bending molds 43 is illustrated in FIG. 7).

The die 41 configures a lower section of the mold unit 40. The die 41 is formed with recesses for forming the vertical walls 20*c* and the flanges 20*d* of the pressed article 20. In other words, the die 41 is formed with a protrusion projecting out from bottom faces of the recesses. The protrusion is formed in a substantially T-shape in plan view, and outer faces of the protrusion are formed corresponding to the shape of inner faces of the top plate 20*a*, the ridge lines 20*b*, and the vertical walls 20*c*.

The pad 42 configures an upper section of the mold unit 40. The pad 42 is disposed facing the die 41 in an up-down direction at a position on the upper side of the die 41 (specifically, the substantially T-shaped protrusion). The pad 42 is formed in a substantially T-shape in plan view, corresponding to the shape of the top plate 20*a*. A lower face of the pad 42 is formed in a shape corresponding to an outer face of the top plate 20*a*.

The bending molds 43 configure an upper section of the mold unit 40 together with the pad 42. The respective bending molds 43 are disposed at the width direction outer sides of the pad 42, and are disposed at positions facing the die 41 in the up-down direction at the upper side of the recess of the die 41. The bending molds 43 are formed in shapes corresponding to the vertical walls 20*c* and the flanges 20*d* of the pressed article 20. Specifically, side faces of the bending molds 43 configure vertical wall forming faces 43A for forming the vertical walls 20*c*. Each of the vertical wall forming faces 43A is configured including a first vertical wall forming face 43A-1 extending along the length direction in plan view, a second vertical wall forming face 43A-2 for forming the vertical wall 20*c* at the curved portion 23, and a third vertical wall forming face 43A-3 extending from the second vertical wall forming face 43A-2 toward the width direction outer side. Moreover, a lower face of each of the bending molds 43 configures a flange forming face 43B for forming the respective flange 20*d*. The flange forming face 43B is formed in a shape corresponding to an outer face of the corresponding flange 20*d*.

A boundary portion between the vertical wall forming face 43A and the flange forming face 43B of each bending mold 43 configures a shoulder portion 43C of the bending mold 43. The shoulder portion 43C is configured by a first shoulder portion 43C-1, a second shoulder portion (curved shoulder portion) 43C-2, and a third shoulder portion 43C-3, corresponding to where the shoulder portion 43C is respectively connected to the first vertical wall forming face 43A-1, the second vertical wall forming face 43A-2, and the third vertical wall forming face 43A-3.

According to a first manufacturing method of the pressed article 20, described later, the pad 42 of the mold unit 40 applies pressure toward the lower side (namely, toward the die 41 side) to the blank 30 at a degree that permits in-plane movement of the blank 30. Specifically, a drive mechanism that drives the pad 42 is configured by a spring drive mechanism, a hydraulic drive mechanism, a gas cushion, or the like.

In cases in which the pressed article 20 is manufactured by a second manufacturing method, described later, configuration is made to give a state in which a gap between the die 41 and the pad 42 is maintained at no less than the sheet thickness of the blank 30, and no more than 1.1 times the sheet thickness of the blank 30. In such cases, the drive mechanism that drives the pad 42 is configured by an electric cylinder, a hydraulic servo device, or the like. Note that the above/below positional relationship of the die 41 and the bending molds 43 is not limited.

Blank 30

Figure 4:
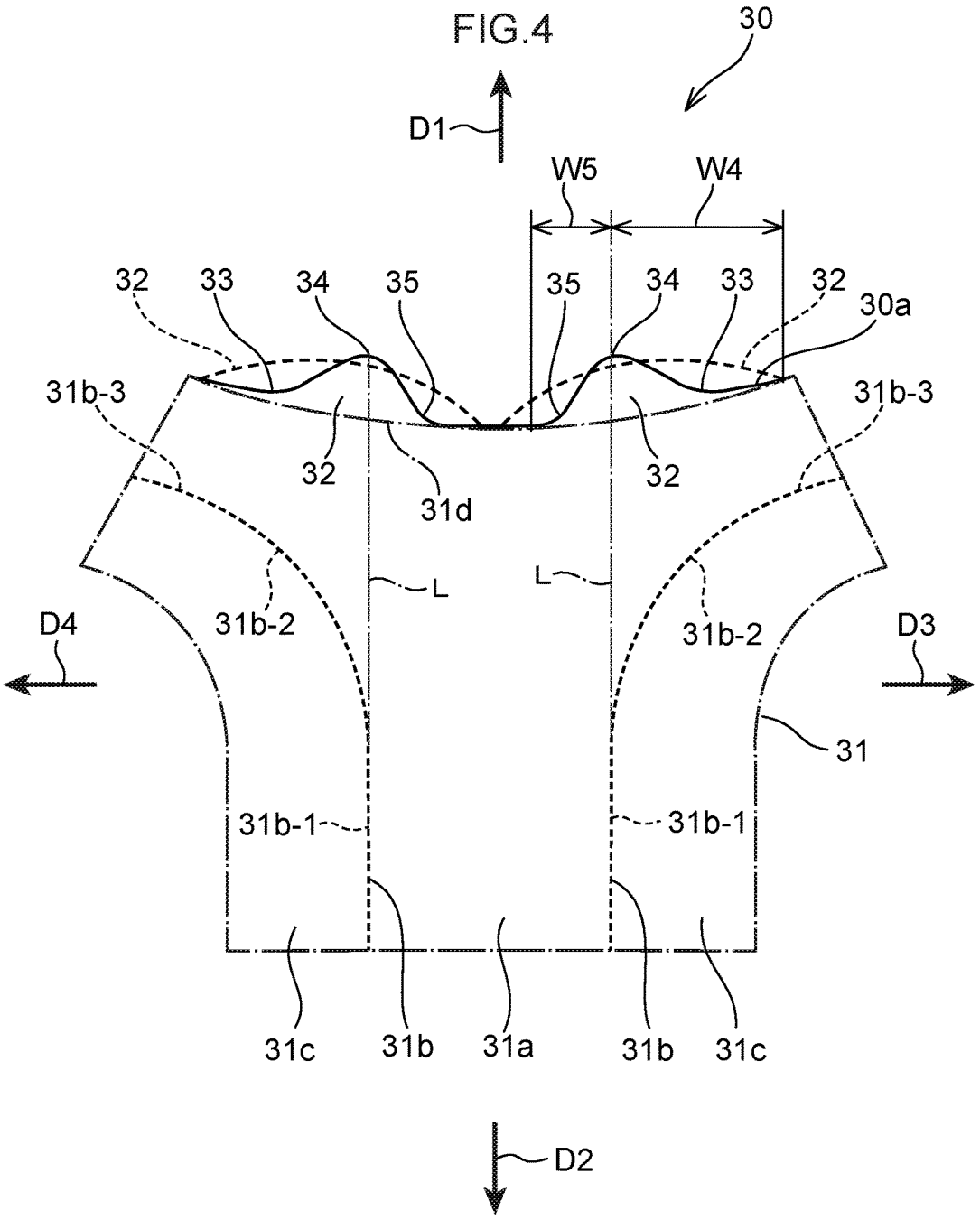
FIG. 4 is a plan view schematically illustrating a blank according to the first exemplary embodiment.

FIG. 4 is a plan view schematically illustrating the blank 30 for forming the pressed article 20 described above. The blank 30 is manufactured in the following shape by processing a sheet steel stock material as appropriate (for example, by laser cutting).

Using the mold unit 40, the pressed article 20 described above is obtained by using the pressing method (free bending method) described later to press the blank 30, or a forming sheet resulting from pre-processing the blank 30, as a stock material.

The pre-processing performed on the blank 30 includes, for example, bending to form slight protrusions in the interior of the blank 30, pressing by drawing, and hole cutting. Such pre-processing may be performed on the blank 30 as appropriate, in consideration of the dimensions and shape of the pressed article 20.

The breaking strength of the blank 30 or the forming sheet is, as an example, set from 400 MPa to 1600 MPa, and the tensile strength of the blank 30 or the forming sheet is, as an example, set from 590 MPa to either 980 MPa or 1180 MPa. Note that a blank 30 of lower strength or higher strength than this may also be employed.

The blank 30 is formed in a substantially T-shape in plan view. Note that a length direction of the blank 30 matches the length direction of the pressed article 20, and a width direction of the blank 30 matches the width direction of the pressed article 20. The blank 30 includes a blank base 31 configuring a base of the blank 30, and the blank base 31 has a shape corresponding to the pressed article 20 when opened out flat (the shape illustrated by single-dotted dashed lines in FIG. 4, also referred to as the "flat pattern" in the present specification). Namely, the blank base 31 is formed in a shape combining a first blank section 31*a* corresponding to the top plate 20*a* of the pressed article 20, and a pair of second blank sections 31*c* corresponding to the pair of vertical walls 20*c* and the pair of flanges 20*d*. Moreover, the first blank section 31*a* and the second blank sections 31*c* are disposed adjacent to each other, on either side of imaginary ridge lines 31*b*. Moreover, an end (edge) on the one length direction side of the blank base 31 is configured by a base edge 31*d*, serving as a "flat pattern edge". Note that the blank base 31 is configured in the shape of a flat pattern found using calculations from the shape set for the pressed article 20. Specifically, JSTAMP software manufactured by JSOL Corporation is employed to find the flat pattern of the pressed article 20, and this flat pattern is set as the shape of the blank base 31. Note that the shape of the blank base 31 may be found using software other than that mentioned above.

In each of the imaginary ridge lines 31*b* of the blank base 31, a portion corresponding to the first ridge line 20*b*-1 of the pressed article 20 configures a first imaginary ridge line 31*b*-1, serving as an "adjacent imaginary line", a portion corresponding to the second ridge line 20*b*-2 configures a second imaginary ridge line 31*b*-2 serving as a "curved imaginary line", and a portion corresponding to the third ridge line 20*b*-3 configures a third imaginary ridge line 31*b*-3. The imaginary ridge lines 31*b* are set in the following manner. Namely, in a state in which the blank 30 has been disposed in the mold unit 40 (the blank 30 has been set in a state positioned on the die 41), and the (flange forming faces 43B of the) bending molds 43 contact an upper face of the blank 30 (the state illustrated on the left sides of FIG. 8A and FIG. 8B. This state is referred to below as the "set state"), imaginary lines extending along the shoulder portions 43C of the respective bending molds 43 in plan view are set as the imaginary ridge lines 31*b*. Specifically, the first imaginary ridge line 31*b*-1, the second imaginary ridge line 31*b*-2, and the third imaginary ridge line 31*b*-3 are respectively configured by imaginary lines corresponding to the first shoulder portion 43C-1, the second shoulder portion 43C-2, and the third shoulder portion 43C-3 of each of the bending molds 43 in plan view. Moreover, although not illustrated in the drawings, a positioning pin is provided to the die 41 described above so as to project out toward the upper side, and the blank 30 is formed with a hole into which the positioning pin is inserted. The blank 30 is thereby positioned with respect to the mold unit 40. Note that instead of the positioning pin described above, a guide section to guide the outer profile of the blank 30 may be formed at the die 41 in order to position the blank 30 with respect to the mold unit 40. Moreover, as will be described in detail later, in the pressing method described below, the vertical walls 20*c* and the flanges 20*d* are formed while the first blank section 31*a* undergoes in-plane movement (slides) inside the mold unit 40. Accordingly, the imaginary ridge lines 31*b* of the blank base 31 do not match the ridge lines 20*b* of the pressed article 20.

Moreover, one length direction side end portion of the blank base 31 is curved in an arc shape opening toward the one length direction side in plan view. In other words, the base edge 31*d* is curved in an arc shape opening toward the one length direction side. As will be described in detail later, in the pressing method (free bending method) of the pressed article 20, the vertical walls 20*c* and the flanges 20*d* corresponding to the second formed section 22 are formed while a portion of the first blank section 31*a* corresponding to the second formed section 22 undergoes in-plane movement (slides) toward the other length direction side inner side the mold unit 40. Accordingly, the one length direction side end portion of the blank base 31 is curved in an arc shape opening toward the one length direction side in plan view so as to correspond to the in-plane movement of the first blank section 31*a*.

A pair of excess portions 32 (see the excess portions 32 illustrated by dashed lines in FIG. 4) that bulge out (project) from the base edge 31*d* toward the one length direction side in plan view are applied to the blank base 31 of the blank 30. The excess portions 32 are provided at positions with left-right symmetry about a width direction center line of the blank 30. Moreover, (outer peripheral) edges of the excess portions 32 are formed in specific shapes (see the excess portions 32 illustrated by continuous lines in FIG. 4), and are connected to the base edge 31*d*. Accordingly, one length direction side edge (this edge is referred to below as the blank edge 30*a*) of the blank 30 is configured by the base edge 31*d* of the blank base 31 and the edges of the pair of excess portions 32. Explanation follows regarding the edges of the excess portions 32. Note that since the pair of excess portions 32 are formed with left-right symmetry about the width direction center line of the blank 30, as described above, explanation follows regarding the excess portion 32 disposed on the one width direction side (the arrow D3 direction side in FIG. 4).

The edge of each excess portion 32 is configured including a first convex portion 34 configuring a width direction intermediate portion of the edge, a first concave portion 33 disposed on the width direction outer side of the first convex portion 34, and a second concave portion 35 disposed on the width direction inner side of the first convex portion 34. The first convex portion 34, the first concave portion 33, and the second concave portion 35 are formed so as to satisfy the following conditions.

Namely, the first convex portion 34 is formed so as to protrude toward the one length direction side of the base edge 31*d*. The first concave portion 33 is adjacent to the first convex portion 34 on the width direction outer side, is formed in a concave shape opening toward the one length direction side, and is connected to the base edge 31*d* and the first convex portion 34. The second concave portion 35 is adjacent to the first convex portion 34 on the width direction inner side, is formed in a concave shape opening toward the one length direction side, and is connected to the base edge 31*d* and the first convex portion 34.

More specifically, taking curvature toward an inner side direction of the blank 30 as negative, and taking curvature toward an opposite direction to the inner side direction as positive, the first convex portion 34 is formed in an arc shape with positive curvature.

The first concave portion 33 is formed in an arc shape with negative curvature, and connects smoothly between the first convex portion 34 and the base edge 31*d* disposed at the width direction outer side of the first convex portion 34. Namely, in the blank edge 30*a*, a tangent to the first convex portion 34 and a tangent to the first concave portion 33 match each other at an inflection point between the first convex portion 34 and the first concave portion 33, and a tangent to the first concave portion 33 and a tangent to the base edge 31*d* match each other at an inflection point between the first concave portion 33 and the base edge 31*d*.

The second concave portion 35 is formed in an arc shape with negative curvature, and connects smoothly between the first convex portion 34 and the base edge 31*d* disposed at the width direction inner side of the first convex portion 34. Namely, in the blank edge 30*a*, a tangent to the first convex portion 34 and a tangent to the second concave portion 35 match each other at an inflection point between the first convex portion 34 and the second concave portion 35, and a tangent to the second concave portion 35 and a tangent to the base edge 31*d* match each other at an inflection point between the second concave portion 35 and the base edge 31*d*.

In this manner, the first concave portion 33, the first convex portion 34, and the second concave portion 35 are disposed side-by-side in this sequence along the edge of the excess portion 32 on progression from the width direction outer side toward the width direction inner side (width direction center side).

Maximum values of the absolute values of the curvatures of the first concave portion 33, the first convex portion 34, and the second concave portion 35 are set to 0.5 (1/mm) or lower. Namely, the first concave portion 33 and the second concave portion 35 are provided in order to suppress flange edge cracking when forming the pressed article 20. When forming the pressed article 20, the first concave portion 33 and the second concave portion 35 stretch out along the width direction of the blank 30, thereby encouraging the blank 30 to flow into the mold unit 40 during pressing. Accordingly, if the absolute values of the curvatures of the first concave portion 33 and the second concave portion 35 were large, a concentration of stress would arise at the first concave portion 33 and the second concave portion 35 (in other words, a proportional reduction in the sheet thickness of the first concave portion 33 and the second concave portion 35 would become large), and top plate edge cracking would tend to occur readily at the first concave portion 33 and the second concave portion 35. Accordingly, the absolute values of the curvatures of the first concave portion 33 and the second concave portion 35 are preferably 0.5 (1/mm) or lower.

The maximum value of the absolute value of the curvature of the base edge 31*d* between the second concave portion 35 of the excess portion 32 disposed on the right side of the width direction center line of the blank 30, and the second concave portion 35 of the excess portion 32 disposed on the left side of the width direction center line, is set to 0.1 (1/mm) or lower.

Figure 5:
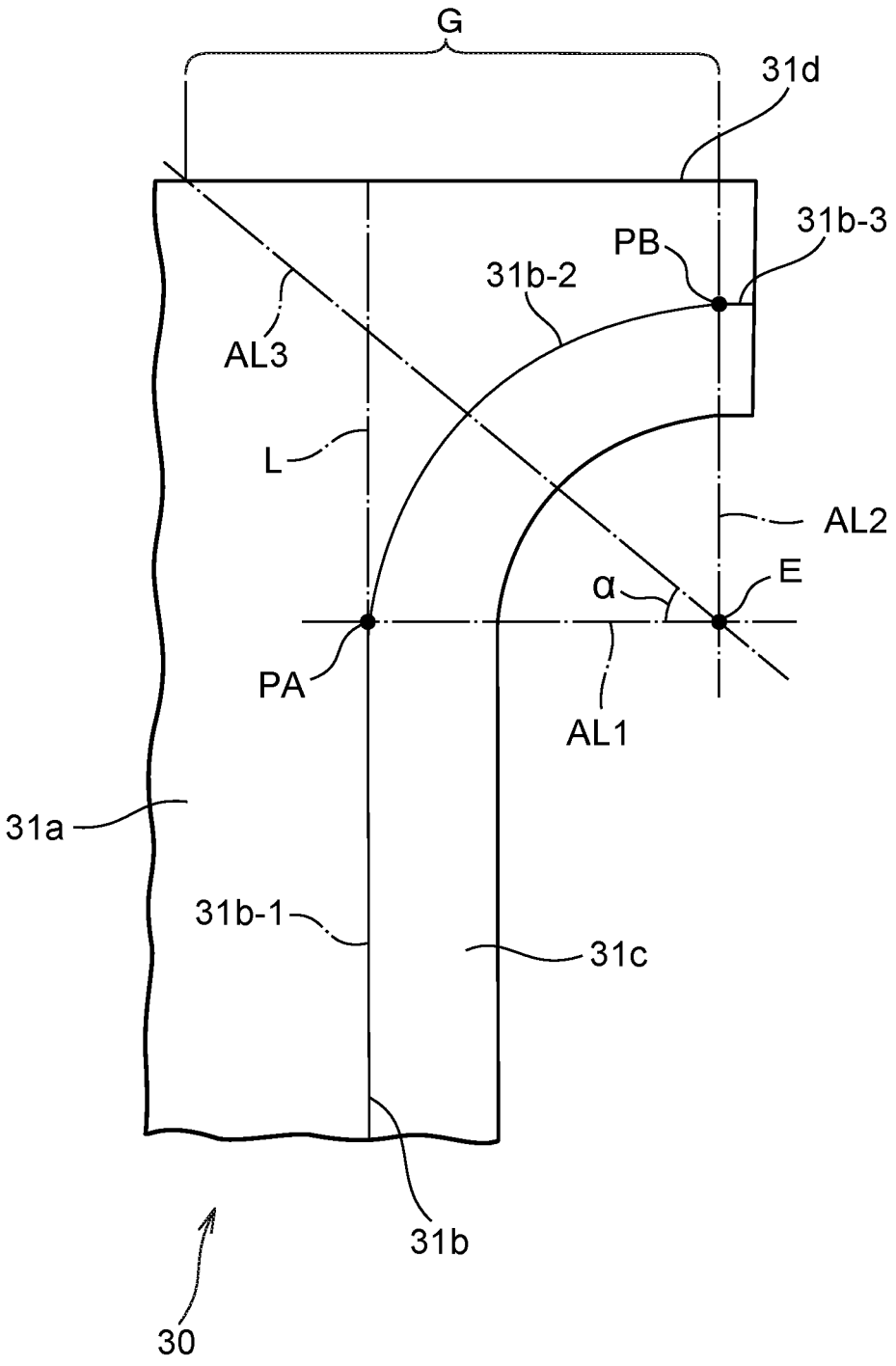
FIG. 5 is an explanatory diagram to explain imaginary ridge lines illustrated in FIG. 4.

Next, explanation follows regarding the positions of the first convex portions 34 in the width direction of the blank 30, with reference to FIG. 5. Note that in FIG. 5, the blank 30 is shown with the first convex portion 34 (excess portion 32) omitted. As illustrated in FIG. 5, a first imaginary line AL1 denotes an imaginary line passing through a base end portion of the second imaginary ridge line 31*b*-2 (namely, through the end portion PA) and extending along the width direction. A second imaginary line AL2 denotes an imaginary line passing through a terminal end portion of the second imaginary ridge line 31*b*-2 (namely, through the end portion PB) and extending along the length direction. An inclined imaginary line AL3 denotes an imaginary line passing through an intersection E between the first imaginary line AL1 and the second imaginary line AL2, and rotated clockwise with respect to the first imaginary line AL1. An angle a formed between the first imaginary line AL1 and the inclined imaginary line AL3 is set at 22.5°. Note that in FIG. 5, for the sake of convenience, the angle a is shown larger than 22.5°.

The first convex portion 34 is set between the inclined imaginary line AL3 and the second imaginary line AL2 (in the range G in FIG. 5). Namely, as described in detail later, in the pressing method (free bending method) described later, when forming the vertical walls 20*c* and the flanges 20*d* of the curved portions 23, the first blank section 31*a* corresponding to the second formed section 22 is drawn in (flows in) substantially toward the other length direction side (the arrow J direction side in FIG. 9). Moreover, it has been found that when this occurs, in the vicinity of the base edge 31*d* of the blank base 31, the reduction in sheet thickness of the blank 30 tends to be distributed in the range G between the inclined imaginary line AL3 and the second imaginary line AL2. Accordingly, the first convex portion 34 is set between the inclined imaginary line AL3 and the second imaginary line AL2. Note that the first convex portion 34 is set as appropriate between the inclined imaginary line AL3 and the second imaginary line AL2 according to the width dimensions of respective locations of the pressed article 20, and according to the shape of the second formed section 22 (T-shape or L-shape). Namely, in cases in which the pressed article 20 is a T-shaped profile component, as in the present exemplary embodiment, a pair of the excess portions 32 are applied to the blank base 31, with each excess portion 32 being set from the width direction center line of the blank 30, up to the corresponding second imaginary line AL2.

In the present exemplary embodiment, the first convex portion 34 (specifically, an apex of the first convex portion 34 (an apex portion of the first convex portion 34 in the length direction of the blank 30)) is disposed on an extension line L running along the first imaginary ridge line 31*b*-1 of the blank 30 and extending from the end portion PA toward the one length direction side. In other words, since the first imaginary ridge line 31*b*-1 meets the second imaginary ridge line 31*b*-2 at the end portion PA, the first convex portion 34 is disposed on a tangent that meets the second imaginary ridge line 31*b*-2 at the end portion PA.

As illustrated in FIG. 4, the edge of each excess portion 32 is formed in a shape that is left-right asymmetrical about the extension line L in the width direction. Specifically, the curvature of the first concave portion 33 is set smaller than the curvature of the second concave portion 35 at the edge of the excess portion 32. In other words, the radius of curvature of the first concave portion 33 is set larger than the radius of curvature of the second concave portion 35. Note that in FIG. 4, the excess portion 32 is shown in an exaggerated manner in order to facilitate understanding of the shape of the excess portion 32.

A width dimension W4 of the excess portion 32 on the width direction outer side of the extension line L (a width dimension from the extension line L to the intersection between the first concave portion 33 and the base edge 31*d*) is set longer than a width dimension W5 of the excess portion 32 on the width direction inner side of the extension line L (a dimension from the extension line L to the intersection between the second concave portion 35 and the base edge 31*d*).

Moreover, a width dimension of the excess portion 32 (width dimension combining the width dimension W4 and the width dimension W5) is set to 1 mm or greater, and no greater than three times the peripheral length of the second ridge line 20*b*-2 that is curved in an arc shape. This is since if the width dimension of the excess portion 32 is less than 1 mm, the reduction in sheet thickness of the blank edge 30*a* during pressing, described later, becomes large, and there is a possibility of top plate edge cracking occurring. Conversely, if the width dimension of the excess portion 32 is more than three times the peripheral length of the second ridge line 20*b*-2, in-plane movement (sliding) of the blank 30 during pressing, described later, is suppressed, and there is a possibility of flange cracking or vertical wall cracking occurring. Namely, the excess portions 32 are essentially portions for suppressing flange cracking and top plate edge cracking, and so the formation range and size of the excess portions 32 are determined from this perspective.

Figure 6:
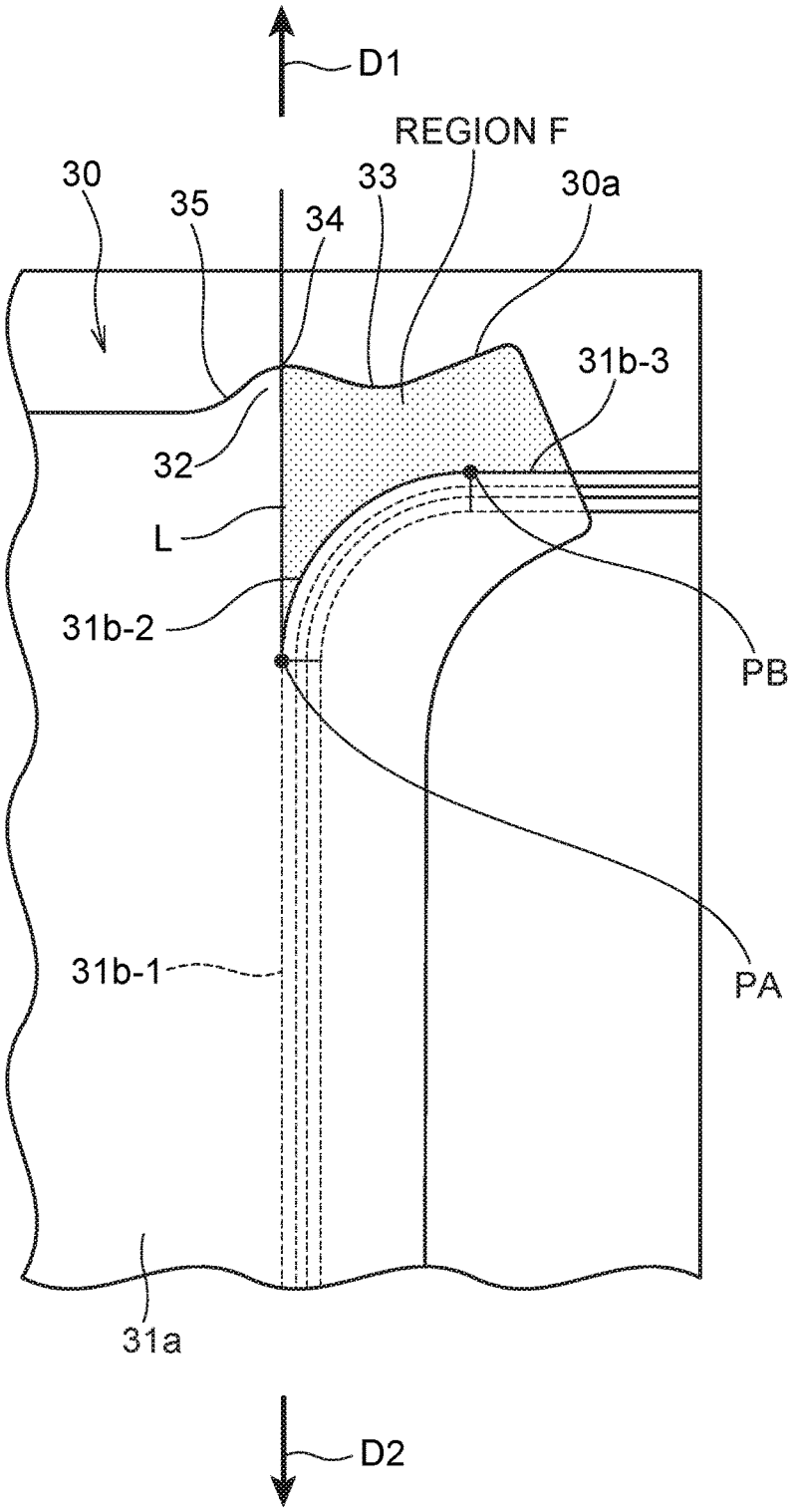
FIG. 6 is an explanatory diagram in which an out-of-plane deformation suppression region of the blank illustrated in FIG. 4 is indicated by hatching.

In the blank 30, it is desirable for the blank edge 30*a* to have a shape that lies in the same plane as the first blank section 31*a* (namely, a shape in which the blank edge 30*a* of the blank 30 is not pulled between the pad 42 and the die 41 during pressing, described later). Namely, as illustrated in FIG. 6, the blank edge 30*a* at a location of the blank 30 corresponding to an out-of-plane deformation suppression region (region F) (the hatched region in FIG. 6) is preferably in the same plane as the first blank section 31*a*. Put another way, a portion of the blank edge 30*a* of the blank 30 lying on the one length direction side of the second imaginary ridge line 31*b*-2 and the third imaginary ridge line 31*b*-3 within the location of the blank 30 corresponding to the out-of-plane deformation suppression region, is preferably present in the same plane as the first blank section 31*a*.

Explanation follows regarding the out-of-plane deformation suppression region (region F). In the manufacturing method of the pressed article 20, described later, the out-of-plane deformation suppression region (region F) is set in order to suppress the occurrence of creases in the top plate 20*a* and the vertical walls 20*c* when forming the pressed article 20. Out-of-plane deformation is suppressed in the out-of-plane deformation suppression region (region F) during manufacture of the pressed article 20. The out-of-plane deformation suppression region (region F) is set in the following manner. Namely, a portion of the first blank section 31*a* of the blank 30 on the width direction outer side of the extension line L and on the one length direction side of the second imaginary ridge line 31*b*-2 and the third imaginary ridge line 31*b*-3 is set as the out-of-plane deformation suppression region (region F). The out-of-plane deformation suppression region (region F) is in contact with a top plate face of the die 41 (specifically, a face aligned with the first blank section 31*a* of the blank 30).

Next, explanation follows regarding operation and advantageous effects of the present exemplary embodiment, while explaining the manufacturing method of the pressed article 20.

Pressed Article 20 Manufacturing Methods (Free Bending Methods)

The pressed article 20 is manufactured using either a first manufacturing method or a second manufacturing method, described below. The first manufacturing method and the second manufacturing method are both methods for manufacturing the pressed article 20 by cold bending the blank 30.

First Manufacturing Method of the Pressed Article 20

The first manufacturing method of the pressed article 20 includes the processes 1-1, 1-2 below.

Process 1-1

Figure 9:
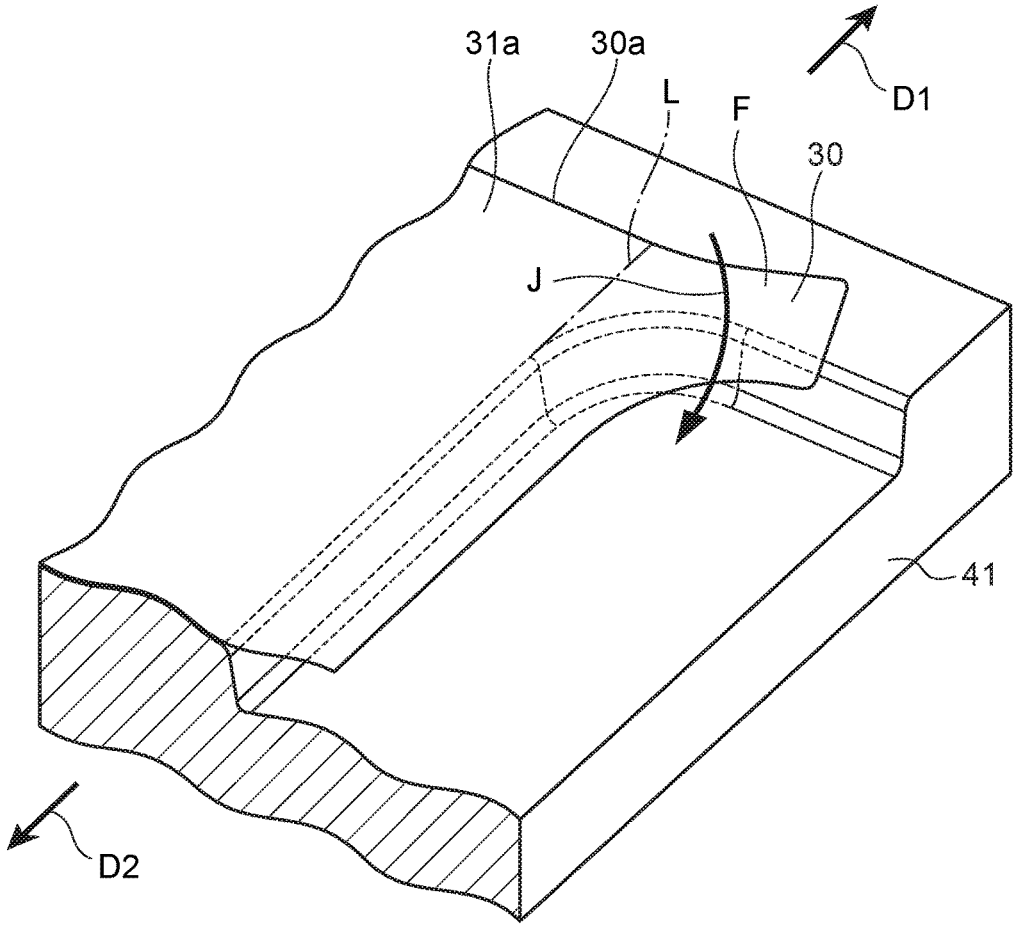
FIG. 9 is a perspective view illustrating a state in which a blank has been placed over a die.

The blank 30, or the forming sheet resulting from preprocessing the blank 30, is set in the mold unit 40. Namely, as illustrated in FIG. 9, the blank 30 or the forming sheet is set on the die 41 in a positioned state.

Process 1-2

Figure 8A:
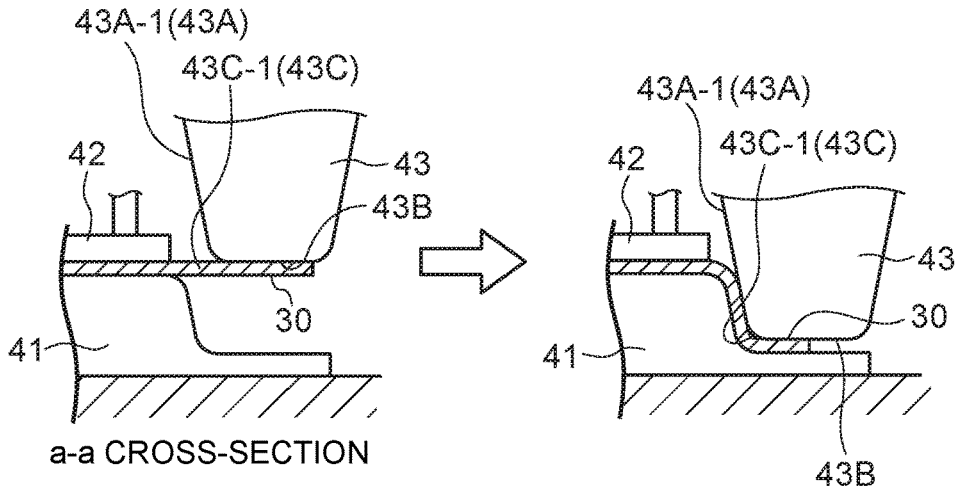
FIG. 8A is an explanatory diagram to explain the outline of a pressing process of the mold unit illustrated in FIG. 7 at the a-a cross-section position in FIG. 3.
Figure 8B:
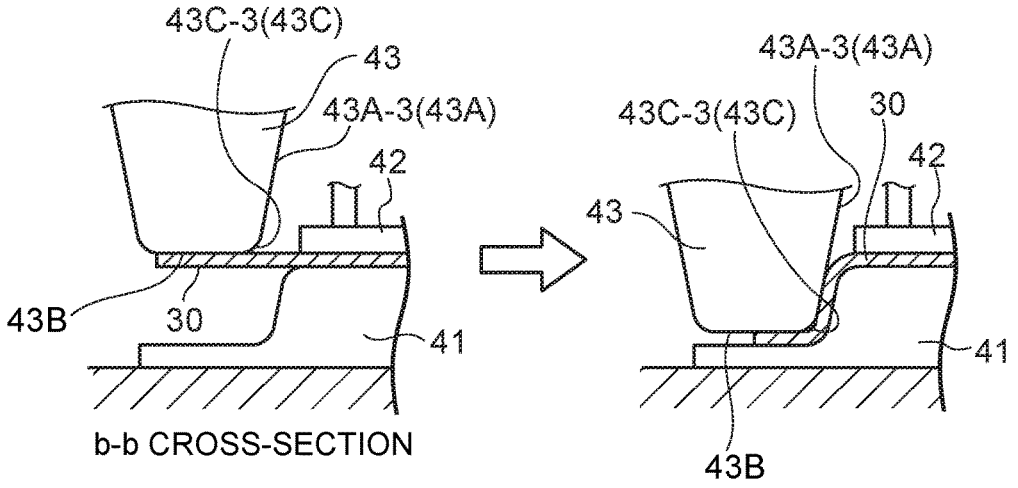
FIG. 8B is an explanatory diagram to explain the outline of a pressing process of the mold unit illustrated in FIG. 7 at the b-b cross-section position in FIG. 3.
Figure 10:
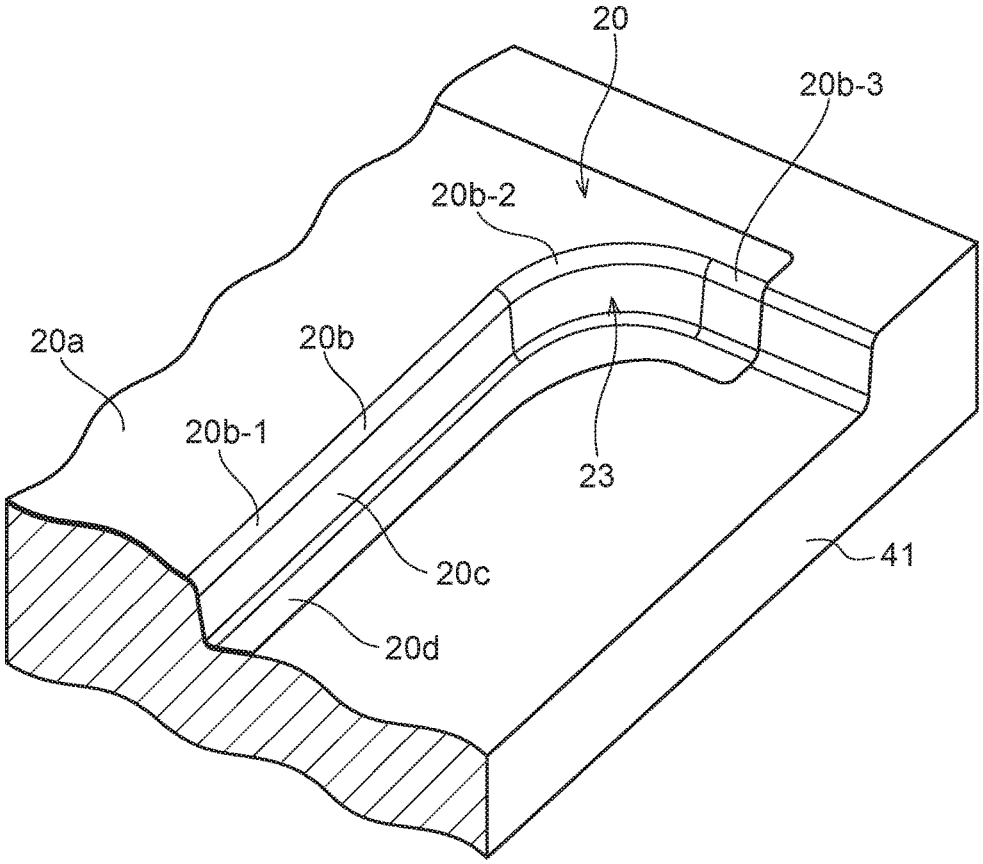
FIG. 10 is a perspective view illustrating a state after a blank has been formed into a pressed article.

Then, in a state in which the blank edge 30*a* of the blank 30 or the forming sheet is present in the same plane as the first blank section 31*a* of the blank 30 or the forming sheet, the out-of-plane deformation suppression region (region F), this being part of the first blank section 31*a*, is applied with pressure by the pad 42 (see the respective left sides of FIG. 8(A) and FIG. 8(B)). In this state, either one or both out of the die 41 or the bending molds 43 are moved in a direction relatively approaching each other. When this is performed, the blank edge 30*a* on the one length direction side of the blank 30 or the forming sheet is bent so as to be pressed into the pair of vertical walls 20*c* and the pair of flanges 20*d* of the pressed article 20 (see the respective right sides of FIG. 8(A) and FIG. 8(B), and also FIG. 10), while being moved in-plane (moved toward the arrow J direction side in FIG. 9) with respect to a location of the die 41 corresponding to the top plate 20*a*.

In this manner, in the first manufacturing method, the occurrence of cracking of the flanges 20*d* and creasing of the top plate 20*a* is suppressed due to configuring part of the blank 30 as the out-of-plane deformation suppression region (region F), and applying a specific load pressure to the out-of-plane deformation suppression region (region F) using the pad 42.

If the load pressure of the pad 42 is set too high, the first blank section 31*a* of the blank 30 in contact with the die 41 is unable to undergo sufficient in-plane movement (sliding) between the die 41 and the pad 42 during pressing. Cracking of the flanges 20*d* occurs in such cases.

Conversely, if the load pressure of the pad 42 is set too low, out-of-plane deformation of the first blank section 31*a* of the blank 30 in contact with the die 41 cannot be restrained during pressing. Creasing of the top plate 20*a* occurs in such cases.

Moreover, when forming sheet steel with a tensile strength of from 200 MPa to 1600 MPa, such as is generally employed in automobile components and the like, cracking of the flanges 20*d* occurs if the pad 42 applies pressure to the blank 30 at a load pressure greater than 30 MPa. Conversely, if the pad 42 applies pressure to the blank 30 at a load pressure of less than 0.1 MPa, out-of-plane deformation of the first blank section 31*a* of the blank 30 cannot be sufficiently suppressed, and creasing of the top plate 20*a* occurs. Accordingly, it is desirable to set the pad 42 to apply pressure of from 0.1 MPa to 30 MPa when forming the sheet steel described above.

Moreover, when presses and mold units such as are generally employed in automobile component manufacture are considered, if the load pressure of the pad 42 is below 0.4 MPa, stable pressure application with the pad 42 using a gas cushion or the like becomes difficult, due to the load pressure being small. Conversely, if the load pressure of the pad 42 is above 15 MPa, high pressure application apparatus becomes necessary due to the load pressure being large, thereby increasing equipment costs. Accordingly, it is desirable for pressure application by the pad 42 to be performed at from 0.4 MPa to 15 MPa.

Note that here, the "pressure" refers to the average pressure over a plane, and is found by dividing the force of the pad pressure by the surface area of the contact region between the pad 42 and the blank 30, and some localized variation may be present.

In the above manufacturing method, for the pad pressure application, the pad 42 employed preferably has a shape covering the entire portion of the blank 30 that contacts the top plate face of the die 41, or covering part of the portion of the blank 30 that contacts the top plate face of the die 41, including the entirety of the out-of-plane deformation suppression region (region F). However, in cases in which due, for example, to the design of the manufactured component, an additional shape has been added to the out-of-plane deformation suppression region (region F), the pad 42 may have a shape such as the following. Namely, the pad 42 may be formed so as to avoid the additional shape portion, and the pad 42 may be formed with a shape that at least includes a region up to 5 mm to the inside of the second imaginary ridge line 31*b*-2 at a location where the out-of-plane deformation suppression region (region F) meets the second imaginary ridge line 31*b*-2, and that covers 50% or more of the surface area of the out-of-plane deformation suppression region (region F). This is since creasing of the top plate 20*a* is liable to occur if, for example, the pad 42 only applies pressure in a region of the first blank section 31*a* up to 4 mm to the inside of this boundary line.

Second Manufacturing Method

The second manufacturing method of the pressed article 20 includes the processes 2-1, 2-2 described below.

Process 2-1

Similarly to in the first manufacturing method, the blank 30 or the forming sheet is set on the die 41 in a positioned state.

Process 2-2

Then, in a state in which the blank edge 30*a* of the blank 30 or the forming sheet is present in the same plane as the first blank section 31*a* of the blank 30 or the forming sheet, the pad 42 is placed in the vicinity of, or in contact with, the out-of-plane deformation suppression region (region F), this being part of the first blank section 31*a*, to attain a state in which a gap between the pad 42 and the die 41 is maintained at no less than the sheet thickness, and no greater than 1.1 times the sheet thickness, of the blank 30 or the forming sheet. In this state, either one or both out of the die 41 or the bending molds 43 are moved in a direction relatively approaching each other. When this is performed, the blank edge 30*a* of the blank 30 or the forming sheet is bent so as to be pressed into the vertical walls 20*c* and the flanges 20*d* of the second formed section 22, while being moved in-plane (moved toward the arrow J direction side in FIG. 9) with respect to a location of the die 41 corresponding to the top plate 20*a*.

In this manner, in the second manufacturing method of the pressed article 20, the gap between the pad 42 and the die 41 is maintained at no less than the sheet thickness, and no greater than 1.1 times the sheet thickness, of the blank 30 or the forming sheet. Accordingly, excessive surface pressure does not act on the blank 30. This thereby allows the blank 30 to undergo sufficient in-plane movement (slide) within the mold unit 40 during pressing. Moreover, in cases in which surplus material arises in the first blank section 31*a* and a force attempting to cause out-of-plane deformation of the blank 30 acts as pressing advances, such out-of-plane deformation of the blank 30 is restrained by the pad 42. This thereby enables the occurrence of cracking and creasing of the pressed article 20 to be suppressed.

Namely, were forming of the blank 30 to be performed with the gap between the pad 42 and the die 41 set to less than the sheet thickness of the blank 30, excessive surface pressure would act between the blank 30 and the die 41. The blank 30 would therefore be unable to undergo sufficient in-plane movement (slide) within the mold unit 40, leading to cracking of the flanges 20*d*.

Conversely, were forming of the blank 30 to be performed with the gap between the pad 42 and the die 41 set to greater than 1.1 times the sheet thickness of the blank 30, out-of-plane deformation of the blank 30 could not be sufficiently restrained during pressing. Accordingly, as pressing advanced, obvious creasing would occur in the top plate 20*a* due to far too much of the blank 30 remaining at the top plate 20*a*. Moreover, buckling would also occur, making it impossible to form a specific shape.

Moreover, it has been found that when forming sheet steel having a tensile strength of from 200 MPa to 1600 MPa, such as is generally employed in automobile components and the like, creasing occurs to some extent when the gap between the pad 42 and the die 41 is 1.03 times the sheet thickness of the blank 30 or greater. Accordingly, in such cases, it is even more desirable to set the gap between the pad 42 and the die 41 at no less than the sheet thickness and no greater than 1.03 times the sheet thickness.

Note that in the second manufacturing method, a "state in which the pad 42 has been placed in the vicinity of the blank 30" means a state in which the blank 30 and the pad 42 do not contact each other when the blank 30 moves in-plane (slides) over the location of the die 41 corresponding to the top plate 20*a*, but the blank 30 and the pad 42 do contact each other if the blank 30 is displaced toward a direction so as to deform out-of-plane (or buckle) over this location. More strictly speaking, the "state in which the pad 42 has been placed in the vicinity of the blank 30" means a state in which the gap between the pad 42 and the die 41 is maintained at greater than 1.0 times the sheet thickness of the blank 30, and no greater than 1.1 times the sheet thickness of the blank 30.

In the second manufacturing method, similarly to in the first manufacturing method, the vertical walls 20*c* and the flanges 20*d* of the second formed section 22 of the pressed article 20 are preferably formed by making the pad 42 approach or contact a region of the blank 30 lying within the first blank section 31*a* and up to at least 5 mm to the inside of the second imaginary ridge line 31*b*-2. Namely, this is since creasing of the top plate 20*a* is liable to occur if, for example, the pad 42 only applies pressure in a region of the first blank section 31*a* up to 4 mm inside the second imaginary ridge line 31*b*-2.

Note that in a pressed article 20 manufactured using the first manufacturing method or the second manufacturing method described above, the outer profile is trimmed to a desired shape, and hole forming and the like are performed in order to manufacture a pressed body as the manufactured component.

As illustrated in FIG. 4, the blank 30 includes the excess portions 32. The excess portions 32 bulge out toward the one length direction side from the base edge 31*d* configuring the one length direction side edge of the blank base 31. The edges of each of the respective excess portions 32 are configured including the first convex portion 34 that protrudes toward the one length direction side of the base edge 31*d*. Accordingly, the blank edge 30*a* of the blank 30 is formed by using the excess portions 32 to increase the thickness of the base edge 31*d* toward the one length direction side. This thereby enables a reduction in the sheet thickness of the blank edge 30*a* (namely the edge of the base edge 31*d* and the excess portions 32) to be suppressed even if the blank edge 30*a* moves in-plane (slides) inside the mold unit 40 during the forming process of the pressed article 20.

Moreover, the edge of each excess portion 32 includes the first concave portion 33 adjacent on the width direction outer side of the first convex portion 34, and the second concave portion 35 adjacent on the width direction inner side (center side) of the first convex portion 34. The first concave portion 33 and the second concave portion 35 are respectively formed in concave shapes opening toward the one length direction side, and connect the base edge 31*d* and the first convex portion 34 together. Boundary portions between the first convex portion 34 and the base edge 31*d* can accordingly be smoothly connected through the first concave portion 33 and the second concave portion 35. This thereby enables a localized reduction in sheet thickness at boundary portions between the first convex portion 34 and the base edge 31*d* in the blank 30 to be suppressed, and enables top plate edge cracking at these boundary portions to be suppressed.

Figure 11A:
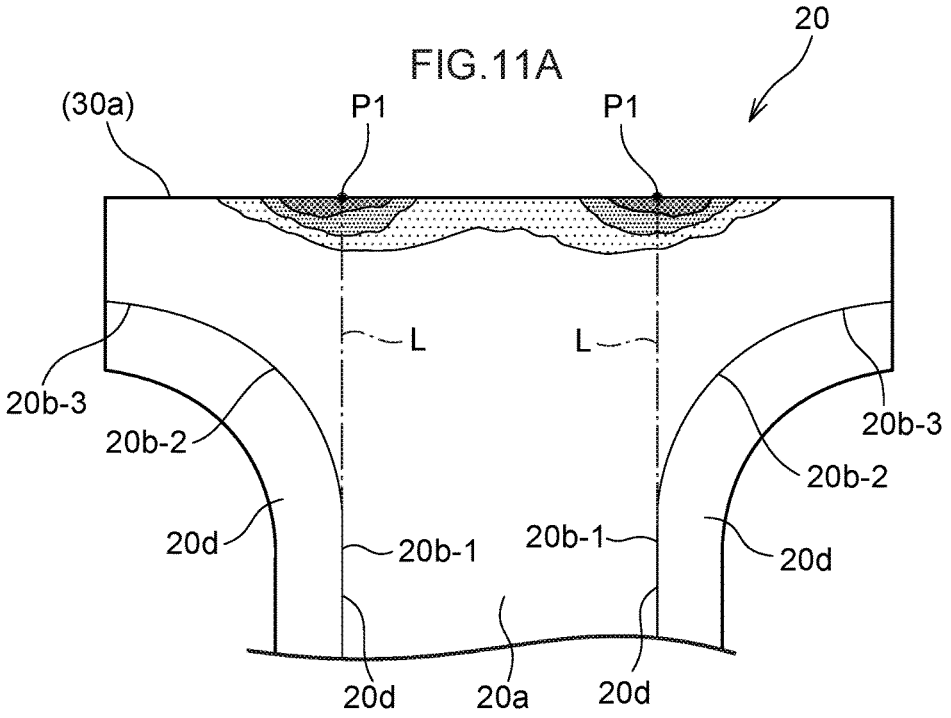
FIG. 11A is an explanatory diagram to explain proportional reduction in sheet thickness in the vicinity of a blank edge after pressing a blank of Comparative Example 1.
Figure 11B:
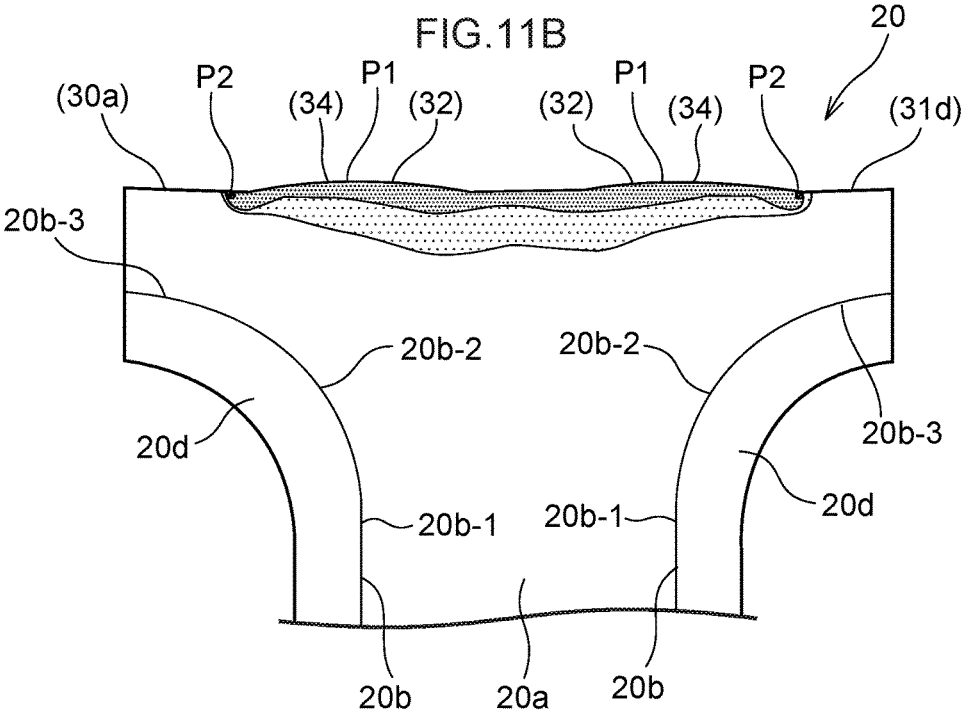
FIG. 11B is an explanatory diagram to explain proportional reduction in sheet thickness in the vicinity of a blank edge after pressing a blank of Comparative Example 2.
Figure 11C:
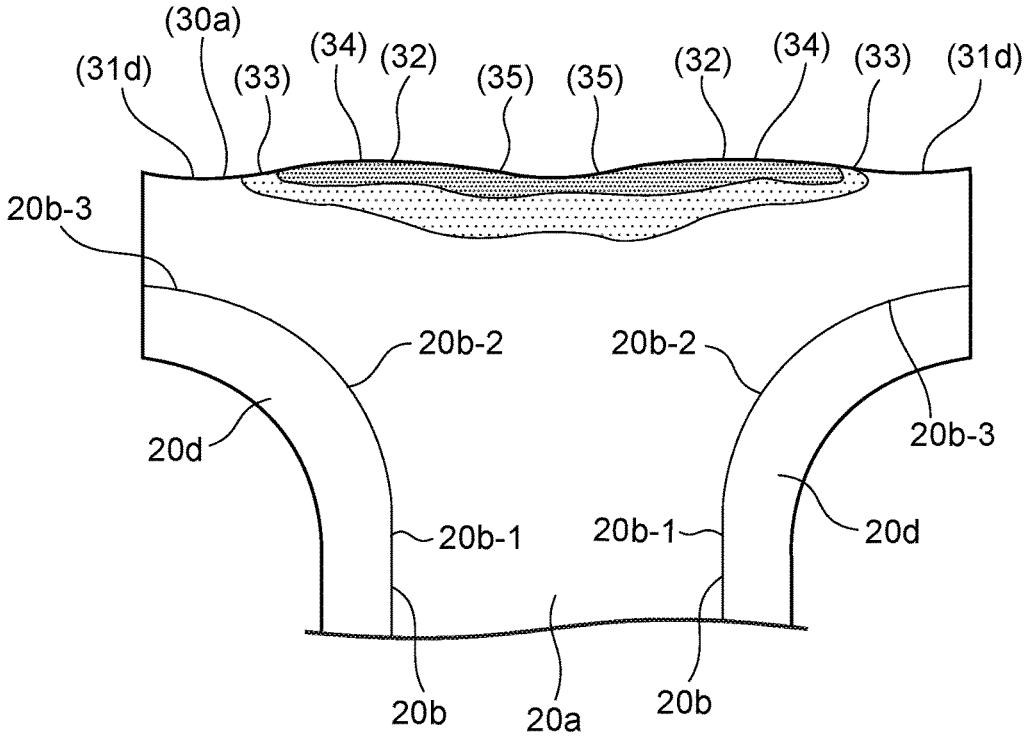
FIG. 11C is an explanatory diagram to explain proportional reduction in sheet thickness in the vicinity of a blank edge after pressing a blank of the first exemplary embodiment.

Explanation follows regarding these points, with reference to comparative examples. FIG. 11A illustrates a pressed article of a Comparative Example 1, with dots illustrating a proportional reduction in sheet thickness in the vicinity of a blank edge. FIG. 11B illustrates a pressed article of a Comparative Example 2, with dots illustrating a proportional reduction in sheet thickness in the vicinity of a blank edge. FIG. 11C illustrates the pressed article 20 of the present exemplary embodiment, with dots illustrating reduction in sheet thickness in the vicinity of the blank edge 30*a*. In FIG. 11A to FIG. 11C, the dot density is greater in regions with a higher proportional reduction in sheet thickness in the pressed article. First, explanation follows regarding the blanks employed in Comparative Example 1 and Comparative Example 2. Note that in the following explanation, the blanks and pressed articles of Comparative Example 1 and Comparative Example 2 are described using the same reference numerals as in the present exemplary embodiment.

In Comparative Example 1 illustrated in FIG. 11A, the excess portions 32 of the present exemplary embodiment are omitted from the blank 30. Namely, in the blank 30 of Comparative Example 1, the blank edge 30*a* is configured by only the base edge 31*d*. Moreover, in Comparative Example 2 illustrated in FIG. 11B, the first concave portions 33 and the second concave portions 35 are omitted from the edges of the excess portions 32 of the blank 30 of the present exemplary embodiment. Namely, in the blank 30 of Comparative Example 2, the blank edge 30*a* is configured by the base edge 31*d* and the first convex portions 34.

As illustrated in FIG. 11A, in Comparative Example 1, due to omitting the excess portions 32 from the blank 30, in the pressed article 20, there is a tendency for a large reduction in sheet thickness of the blank 30 to occur in the vicinity of two locations P1 on the blank edge 30*a*. Explanation follows regarding this point. In the blank 30, each second blank section 31*c* is disposed adjacent to, and on the other length direction side of, the second imaginary ridge line 31*b*-2 and the third imaginary ridge line 31*b*-3 (see FIG. 4). Accordingly, when the vertical walls 20*c* and the flanges 20*d* of the second formed section 22 are formed as illustrated in FIG. 9 using the first manufacturing method or the second manufacturing method, the out-of-plane deformation suppression region (region F) of the first blank section 31*a* in particular moves in-plane (slides) toward the other length direction side (toward the arrow D2 side in FIG. 9). Namely, in the first blank section 31*a* of the blank 30, portions at the width direction outer sides of the extension lines L in particular undergo in-plane movement (slide) toward the other length direction side.

Figure 12:
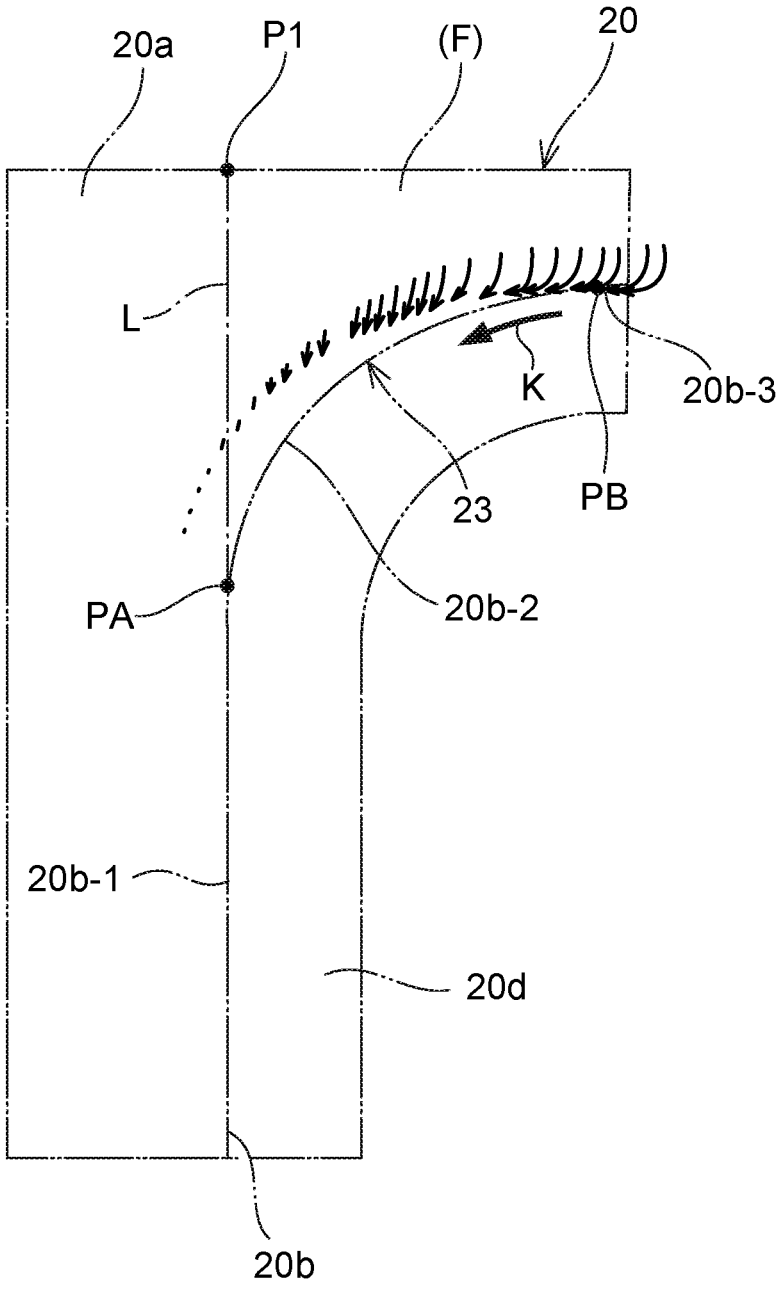
FIG. 12 is a plan view to explain material in-flow paths when pressing a pressed article.
Figure 13:
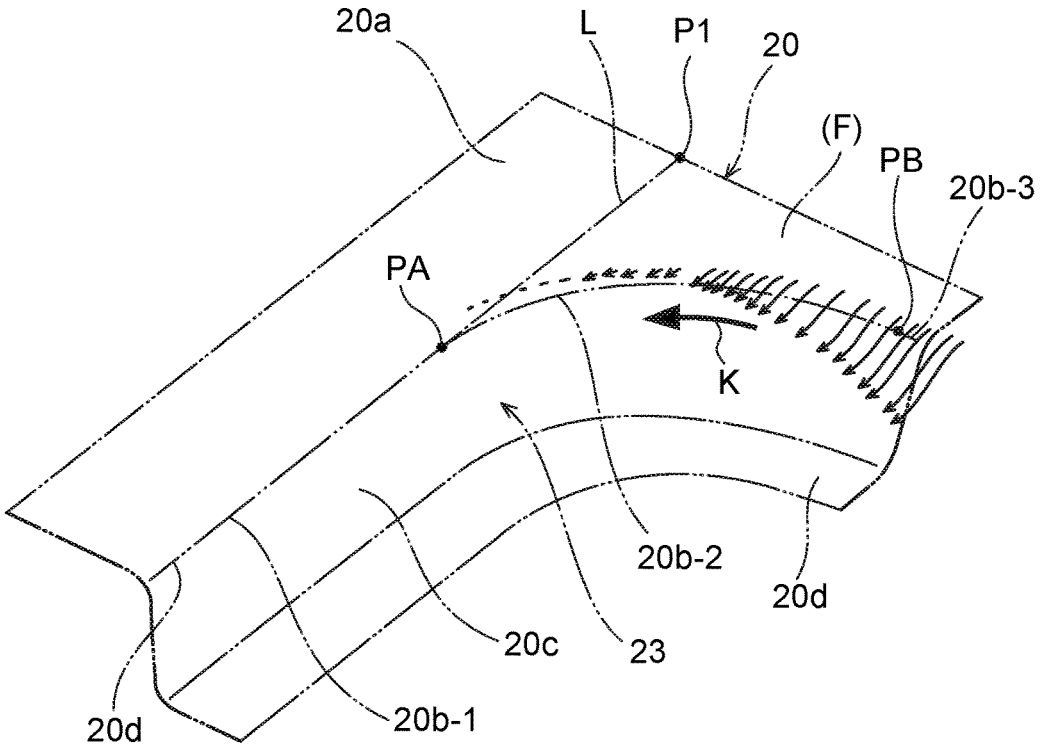
FIG. 13 is a perspective view to explain material in-flow paths when pressing a pressed article.

In FIG. 12 and FIG. 13, arrows are used to indicate in-flow paths of the material of the top plate 20*a* flowing toward the side of the vertical wall 20*c* and the flange 20*d* when the first blank section 31*a* moves in-plane (slides). As illustrated in FIG. 12 and FIG. 13, in the in-flow paths of the material of the top plate 20*a*, the in-flow paths of the material of the top plate 20*a* become longer on progression from the end portion PA on the second ridge line 20*b*-2 toward the end portion PB side. Namely, the in-flow paths of the material of the top plate 20*a* become longer on progression toward the width direction outer side of the second ridge line 20*b*-2. Accordingly, the out-of-plane deformation suppression region F (the portion of the first blank section 31*a* on the width direction outer side of the extension line L) moves in-plane (slides) so as to sweep around toward the other length direction side about an origin in the vicinity of the intersection P1 between the extension line L, this being a tangent to the second ridge line 20*b*-2 at the end portion PA, and the blank edge 30*a* (see arrow J in FIG. 9).

When the material of the top plate 20*a* flows in toward the side of the vertical wall 20*c* and the flange 20*d*, the material is gathered along the peripheral direction of the curved ridge line at a portion of the top plate 20*a* in the vicinity of the second ridge line 20*b*-2 (see the arrow K in FIG. 12), and the top plate 20*a* accordingly attempts to undergo out-of-plane deformation. However, as described above, in the free bending method, out-of-plane deformation of the top plate 20*a* is restrained by the pad 42. Accordingly, force arising when the top plate 20*a* is being restrained propagates such that the top plate 20*a* (first blank section 31*a*) is pulled substantially along the width direction. Namely, in the first blank section 31*a*, the out-of-plane deformation suppression region F in particular is pulled substantially in the width direction while moving in-plane so as to sweep around toward the other length direction side. Accordingly, in Comparative Example 1, as illustrated in FIG. 11A, tensile stress concentrates in the vicinity of the intersections P1, and the reduction in sheet thickness of the blank edge 30*a* is concentrated in the vicinity of the intersections P1. As a result, in Comparative Example 1, there is a large reduction in the sheet thickness of the blank 30 in the vicinity of the two intersections P1, and there is a possibility of top plate edge cracking occurring.

By contrast, in Comparative Example 2, the first convex portions 34 are formed at the blank edge 30*a* as illustrated in FIG. 11B. Accordingly, the first convex portions 34 bulge out toward the one length direction side in the vicinity of the intersections P1 on the blank edge 30*a* (in other words, the blank edge 30*a* is thickened toward the one length direction side in the vicinity of the locations P1). This alleviates the concentration of tensile stress in the vicinity of the intersections P1 at the blank edge 30*a* when the blank edge 30*a* undergoes in-plane movement, suppressing the reduction in sheet thickness from becoming large in the vicinity of the intersections P1 on the blank edge 30*a*. As a result, in Comparative Example 2, top plate edge cracking is suppressed from occurring in the pressed article at the two intersections P1.

However, in Comparative Example 2, the first concave portions 33 and the second concave portions 35 of the present exemplary embodiment are omitted from the edges of the excess portions 32. The curvature of the blank edge 30*a* is therefore discontinuous about intersections P2 between the respective first convex portions 34 and the base edge 31*d*. Accordingly, in the blank edge 30*a*, localized concentration of tensile stress occurs at the intersections P2 when the blank edge 30*a* undergoes in-plane movement (slides). There is accordingly a localized reduction in the sheet thickness of the blank 30 at the intersections P2 between the first convex portions 34 and the base edge 31*d*. As a result, there is a possibility of top plate edge cracking occurring at the intersections P2.

By contrast, in the present exemplary embodiment illustrated in FIG. 11C, the edge of each excess portion 32 is configured by the first convex portion 34, the first concave portion 33, and the second concave portion 35. Accordingly, in comparison to Comparative Example 2, discontinuity in the curvature of the blank edge 30*a* at the boundary portion between the first convex portion 34 and the base edge 31*d* is suppressed by the first concave portion 33 and the second concave portion 35. Accordingly, when the blank edge 30*a* moves in-plane (slides), tensile stress acting at the blank edge 30*a* becomes substantially uniform along the width direction. In other words, localized concentration of the tensile stress at the intersection P2 described above is suppressed. As a result, a localized reduction in the sheet thickness of the blank 30 at the boundary portion between the first convex portion 34 and the base edge 31*d* is suppressed, and the proportional reduction in sheet thickness of the blank edge 30*a* becomes substantially uniform along the width direction. This thereby enables top plate edge cracking of the blank edge 30*a* to be suppressed.

Due to the above, forming the pressed article 20 with the free bending method using the blank 30 of the present exemplary embodiment enables the occurrence of top plate edge cracking of the pressed article 20 to be suppressed.

Moreover, as described above, when forming the pressed article 20, the blank edge 30*a* moves in-plane (slides) toward the other length direction side, and the first concave portions 33 and the second concave portions 35 of the edges of the respective excess portions 32 are stretched out along the width direction. Accordingly, in comparison to Comparative Example 2, the blank edge 30*a* of the blank 30 can be encouraged to flow inside the mold unit 40 when forming the pressed article 20. The displacement amount of the first blank section 31*a* of the blank 30 toward the side of the vertical walls 20*c* and the flanges 20*d* is thereby increased, thus enabling the occurrence of flange edge cracking of the pressed article 20 to be suppressed during pressing.

Regarding this point, explanation follows regarding the occurrence of top plate edge cracking and flange edge cracking when pressed articles are manufactured from blanks of various shapes, as illustrated in FIG. 14A to FIG. 14E, with reference to Table 1 below. Note that the variously shaped blanks illustrated in FIG. 14A to FIG. 14E each employ high tensile sheet steel with a tensile strength of 1180 MPa and a sheet thickness of 1.6 mm. Moreover, in manufacture of the various pressed articles mentioned above, blank top plate portions of the blanks are held down by the pad 42, and then the respective pressed articles are manufactured using a free bending method (the first manufacturing method described above) using the die 41 and the bending molds 43 for bending.

Figure 14A:
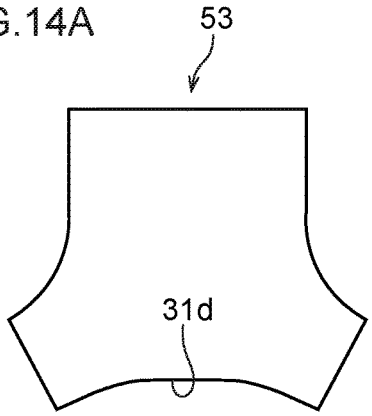
FIG. 14A is a plan view schematically illustrating a blank of Comparative Example 3.
Figure 14B:
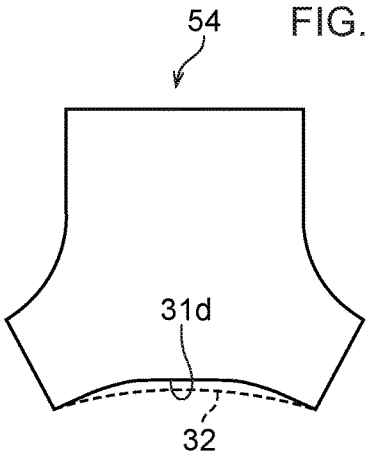
FIG. 14B is a plan view schematically illustrating a blank of Comparative Example 4.
Figure 14C:
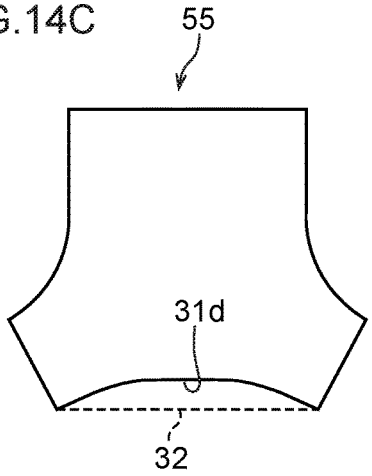
FIG. 14C is a plan view schematically illustrating a blank of Comparative Example 5.
Figure 14D:
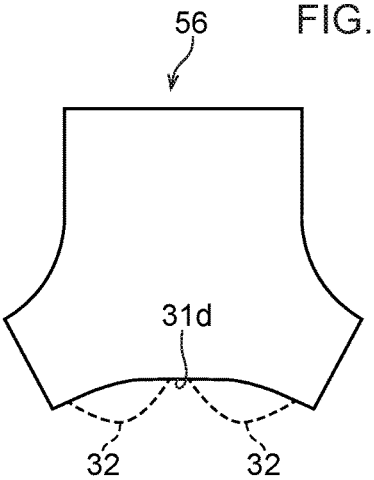
FIG. 14D is a plan view schematically illustrating a blank of Comparative Example 6.
Figure 14E:
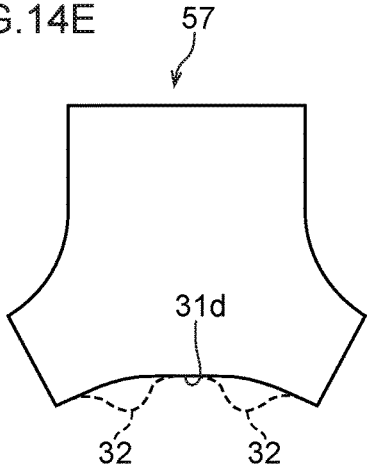
FIG. 14E is a plan view schematically illustrating a blank of the first exemplary embodiment.

First, explanation follows regarding blanks 53 to 56 of Comparative Example 3 to Comparative Example 6 illustrated in FIG. 14A to FIG. 14D, and an example of the blank 30 of the present exemplary embodiment illustrated in FIG. 14E. As illustrated in FIG. 14A, in the blank 53 of Comparative Example 3, the excess portions 32 of the present exemplary embodiment are omitted (namely, this is a blank with the same specifications as Comparative Example 1 above). As illustrated in FIG. 14B, in the blank 54 of Comparative Example 4, an excess portion 32 having an edge with negative curvature is formed at one length direction end of the blank 30, and the radius of curvature of the excess portion 32 is set to 300 mm. As illustrated in FIG. 14C, the blank 55 of Comparative Example 5 is formed with an excess portion 32 having an edge extending in a straight line along the width direction. As illustrated in FIG. 14D, the blank 56 of Comparative Example 6 is formed with a pair of excess portions 32 having edges with positive curvature, and the radii of curvature of the excess portions 32 are set to 150 mm. In the blank 56 of Comparative Example 6, the first concave portions 33 and the second concave portions 35 of the present exemplary embodiment are omitted (namely, this is a blank with the same specifications as Comparative Example 2). As illustrated in FIG. 14E, in the example of the blank 30 of the present exemplary embodiment, the respective radii of curvature of the first convex portions 34, the first concave portions 33, and the second concave portions 35 of the pair of excess portions 32 are each set to 100 mm. Moreover, the surface area of the excess portions 32 is set smaller than in Comparative Example 5.

TABLE 1

| | Blank Shape | | | | |
|---|---|---|---|---|---|
| | Comparative Example 3 (53) | Comparative Example 4 (54) | Comparative Example 5 (55) | Comparative Example 6 (56) | Present Exemplary Embodiment (30) |
| Flange Cracking at Regions A | Absent | Absent | Present | Absent | Absent |
| Edge Cracking at Region B | Present | Present | Absent | Present | Absent |

As shown in Table 1, in Comparative Example 3, although flange cracking did not occur at regions A (see FIG. 1), top plate edge cracking did occur at region B (see FIG. 1), similarly to in Comparative Example 1 above. In Comparative Example 4, the surface area at the one length direction end portion of the blank 54 is larger than in Comparative Example 3 by the amount added by the excess portion 32. Accordingly, the proportional reduction in sheet thickness at region B was reduced, but top plate edge cracking still occurred at region B. Moreover, in Comparative Example 5, the surface area of the one length direction end portion of the blank 55 is larger than in Comparative Example 4. Accordingly, the proportional reduction in sheet thickness at region B was reduced, and top plate edge cracking at region B could be averted. However, in Comparative Example 5, the larger surface area at the one length direction end portion of the blank 55 makes it difficult for the blank edge to undergo in-plane movement during pressing, and the displacement amount from the portion of the blank 55 that forms the top plate toward the side of the vertical walls and the flanges is small. Flange cracking therefore occurred in the pressed article. In Comparative Example 6, similarly to in Comparative Example 2 above, there were localized reductions in the sheet thickness of the blank 56 at the intersections between the first convex portions and the base edge, and top plate edge cracking occurred at these intersections (inflection points).

By contrast, the example illustrated in FIG. 14E, this being an example of the present exemplary embodiment, enables the proportional reduction in sheet thickness at the blank edge 30*a* to be reduced. Moreover, the surface area of the excess portions 32 is smaller than in the blank 55 of Comparative Example 5, and there is good in-plane movement of the blank edge 30*a*. This thereby enables the proportional reduction in sheet thickness at regions A to be kept small. Accordingly, the present exemplary embodiment is capable of preventing not only flange edge cracking at regions A, but also top plate edge cracking at region B.

As described above, forming the pressed article 20 with a free bending method using the blank 30 of the present exemplary embodiment enables top plate edge cracking to be suppressed, and also enables flange cracking to be suppressed in the pressed article 20.

In the blank 30 of the present exemplary embodiment, the excess portions 32 are disposed on tangents to the end portions PA of the second ridge lines 20*b*-2 (in other words, on the extension lines L). Specifically, the apex portions (apexes) of the excess portions 32 are disposed on tangents to the end portions PA of the second ridge lines 20*b*-2 (in other words, on the extension lines L). Accordingly, the blank 30 is thickened toward the one length direction side in the vicinity of the intersections P1, where would otherwise be a large proportional reduction in sheet thickness of the blank 30 during the pressing process. This thereby enables a reduction in sheet thickness of the blank 30 in the vicinity of the intersections P1 to be effectively suppressed, and enables top plate edge cracking to be effectively suppressed.

Moreover, in the present exemplary embodiment, in plan view, each of the excess portions 32 is formed with left-right asymmetry about the extension line L in the width direction. Specifically, the curvature of the first concave portion 33 is set smaller than the curvature of the second concave portion 35. In other words, the radius of curvature of the first concave portion 33 is set larger than the radius of curvature of the second concave portion 35. Accordingly, the difference between the curvature of the first convex portion 34 and the curvature of the first concave portion 33 can be made smaller than the difference between the curvature of the first convex portion 34 and the curvature of the second concave portion 35. This thereby enables the proportional reduction in sheet thickness to be made even more uniform at the excess portions 32, and enables top plate edge cracking of the pressed article 20 to be even more effectively suppressed.

Moreover, in the present exemplary embodiment, the width dimension W4 of each excess portion 32 on the width direction outer side of the extension line L is set longer than the width dimension W5 of the excess portion 32 on the width direction inner side of the extension line L. This thereby enables top plate edge cracking of the pressed article 20 to be effectively suppressed. Namely, as described above, when the blank edge 30*a* moves in-plane (slides) toward the arrow J direction side in FIG. 9 during pressing, the blank edge 30*a* corresponding to the out-of-plane deformation suppression region (region F) in particular moves in-plane (slides) toward the other length direction side. Namely, in particular, the portion of each excess portion 32 on the width direction outer side of the extension line L moves in-plane (slides) toward the other length direction side. Accordingly, setting the width dimension W4 of each excess portion 32 at a portion on the width direction outer side of the extension line L longer than the width dimension W5 of the excess portion 32 at a portion on the width direction inner side of the extension line L enables the reduction in sheet thickness to be effectively suppressed at the portion on the width direction outer side of the extension line L. This thereby enables top plate edge cracking of the pressed article 20 to be effectively suppressed.

Figure 15:
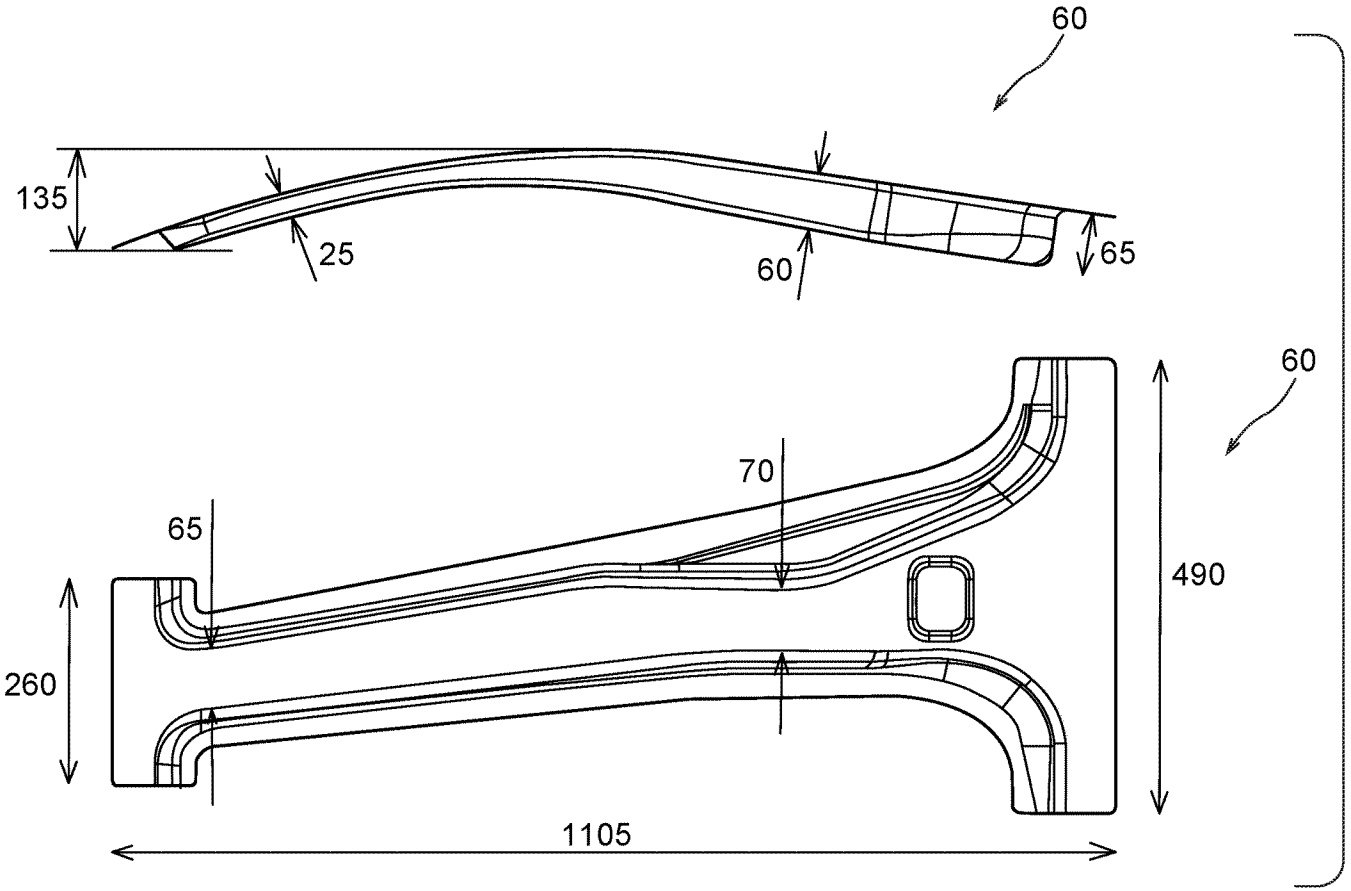
FIG. 15 is a view in two planes illustrating the shape of a pressed article when a pressed article of the first exemplary embodiment is employed as a vehicle framework component.

Moreover, in the present exemplary embodiment, performing a free bending method using the blank 30 enables the occurrence of flange cracking and top plate edge cracking to be prevented in the pressed article 20, while securing a width W3 of 300 mm or greater or 400 mm or greater at the one length direction side end portion of the pressed article 20. Accordingly, the present exemplary embodiment enables the manufacture of a framework configuration component 60 configuring a vehicle framework component, such as that illustrated in FIG. 15 (FIG. 15 illustrates a framework configuration component configuring a vehicle center pillar). Explanation follows regarding examples of dimensions of the framework configuration component 60.

Namely, the framework configuration component 60 illustrated in FIG. 15 has an overall length of 1105 mm, and the width of a top plate corresponding to the first formed section 21 is from 65 mm to 70 mm. The widths of the top plate at an upper end portion and a lower end portion corresponding to second formed sections 22 (namely, length direction end portions) are respectively 260 mm and 490 mm, and the height of the vertical walls is 65 mm at its maximum point. The flange width is 25 mm. Blanks for the framework configuration component 60 are manufactured from three types of high tensile sheet steel of 590 MPa grade, 980 MPa grade, and 1180 MPa grade tensile strength, and each has a sheet thickness of 1.6 mm. Accordingly, in the example illustrated in FIG. 15, the framework configuration component 60 secures a width at the lower end portion, this being a length direction end portion, of 400 mm or greater.

In the framework configuration component 60 illustrated in FIG. 15, the length direction end portions (the upper end portion and the lower end portion) configure joints with other members (for example, a roof rail or a side sill). Moreover, the framework configuration component 60 is joined to the other members through the joints by means such as spot welding or laser welding. Accordingly, employing the blank 30 of the present exemplary embodiment enables the joint surface area of the locations configuring joints with other members to be increased (secured) in the framework configuration component 60. This thereby enables the joint strength to other components to be increased. In particular, this enables bending rigidity and twisting rigidity of a vehicle body shell to be improved in cases in which the pressed article is a vehicle body configuration member such as the framework configuration component 60 (for example various pillar outer reinforcement and sill outer reinforcement).

Moreover, in the present exemplary embodiment, the pressed article 20 is configured as a T-shaped profile component. However, the pressed article 20 may be configured as a Y-shaped profile component. In such cases, the pressed article 20 is applied to automobile rear member reinforcement or the like.

Second Exemplary Embodiment

Figure 16:
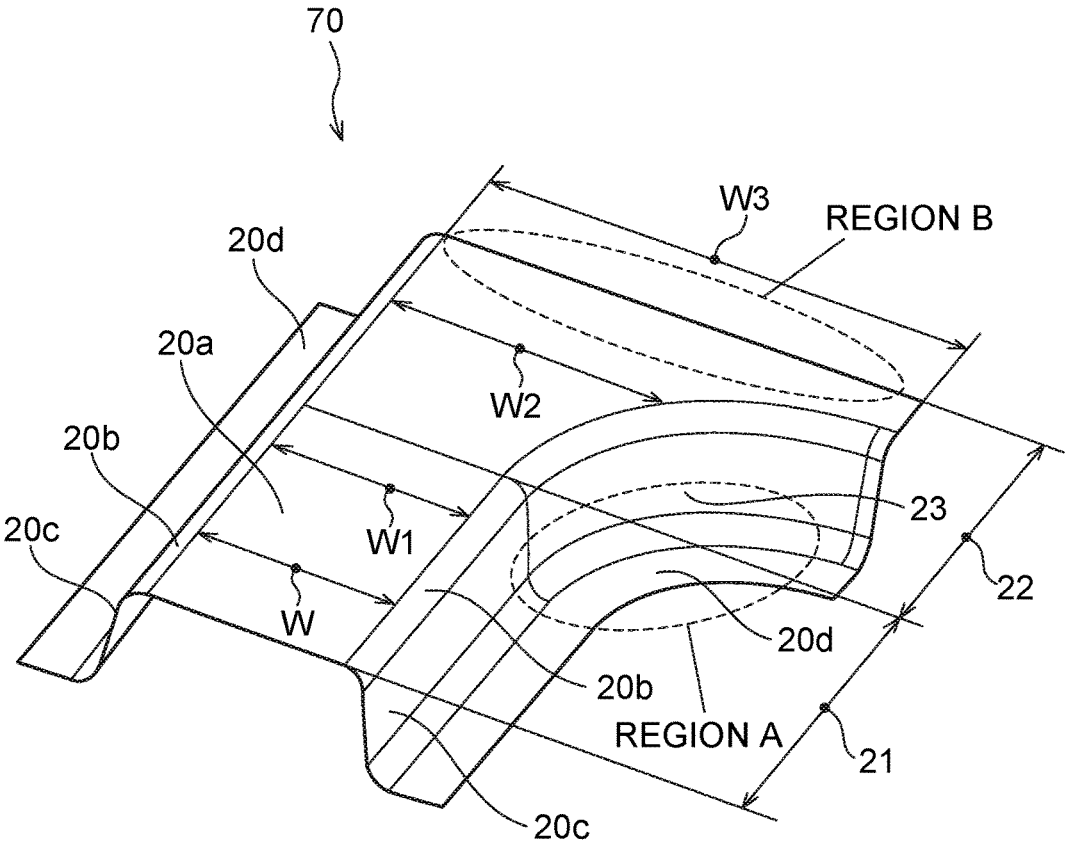
FIG. 16 is a perspective view schematically illustrating a pressed article formed employing a blank according to a second exemplary embodiment.

As illustrated in FIG. 16, in a second exemplary embodiment, a pressed article 70 is configured as an L-shaped profile component. Explanation follows regarding the pressed article 70 and a blank 80 of the second exemplary embodiment. Note that in the following explanation, portions of the pressed article 70 and the blank 80 with similar configuration to the pressed article 20 and the blank 30 of the first exemplary embodiment are allocated the same reference numerals.

Namely, as illustrated in FIG. 16, the pressed article 70 includes the top plate 20*a*, the ridge lines 20*b*, the vertical walls 20*c*, and the flanges 20*d*. Moreover, in the pressed article 70, only one of the vertical walls 20*c* is curved to extend out toward the width direction outer side in the second formed section 22. Namely, the other vertical wall 20*c* is formed with a flat plane shape along the entire length direction, and the curved portion 23 is only formed at a single location in the pressed article 70.

The following dimensions are examples of the dimensions of the pressed article 70. Namely, a length direction dimension of the pressed article 70 is set in a range of from 100 mm to 1600 mm (for example, 300 mm in the present exemplary embodiment). The width W1 of the top plate 20*a* is set in a range of from 50 mm to 200 mm (for example 100 mm in the present exemplary embodiment), and the width W3 at the one length direction end portion of the top plate 20*a* is set in a range of from 70 mm to 1000 mm (for example, 210 mm in the present exemplary embodiment). The height of the vertical walls 20*c*, the radius of curvature of the curved vertical wall 20*c*, and the width of the flanges 20*d* are set similarly to in the first exemplary embodiment.

Figure 17:
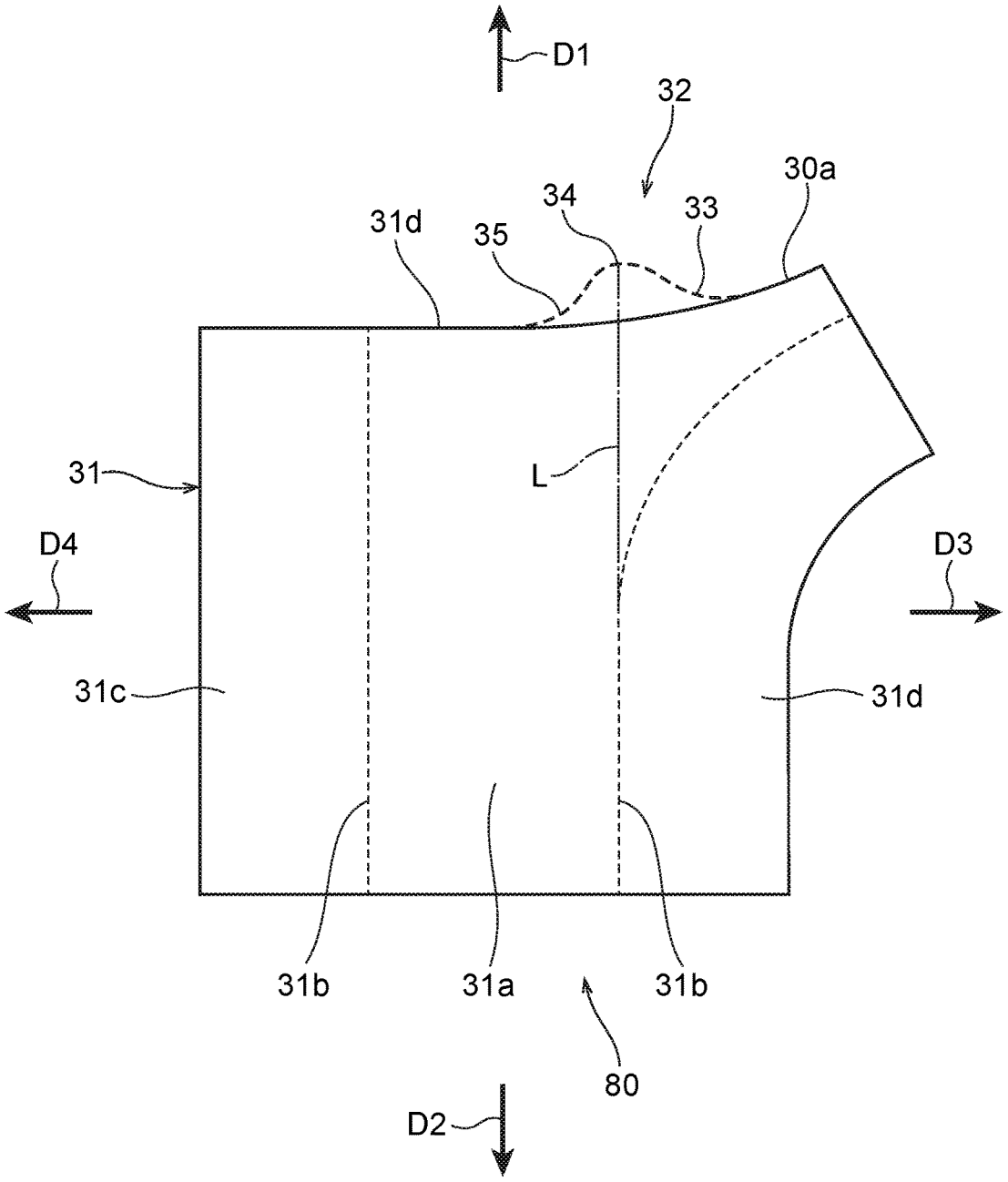
FIG. 17 is a plan view schematically illustrating a blank according to the second exemplary embodiment.

Moreover, as illustrated in FIG. 17, in the blank 80 of the second exemplary embodiment, the base edge 31*d* is curved so as to incline toward the one length direction side (the arrow D1 direction side in FIG. 17) on progression toward the one width direction side (the arrow D3 direction side in FIG. 17). Similarly to in the first exemplary embodiment, the excess portion 32 is formed at the base edge 31*d* and disposed over the extension line L.

Figure 18:
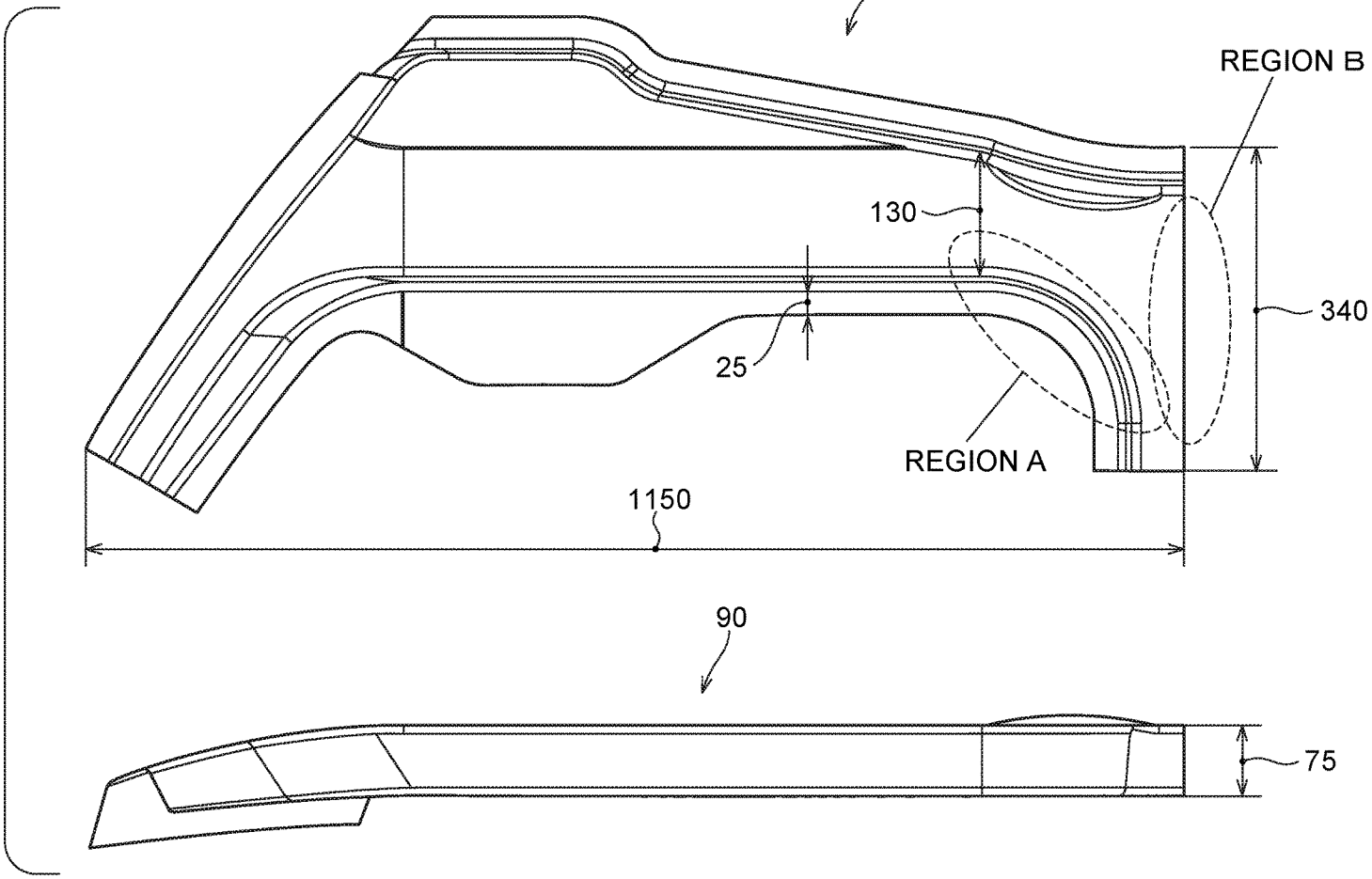
FIG. 18 is a view in two planes illustrating the shape of a pressed article when a pressed article of the second exemplary embodiment is employed as a vehicle framework component.
Figure 19:
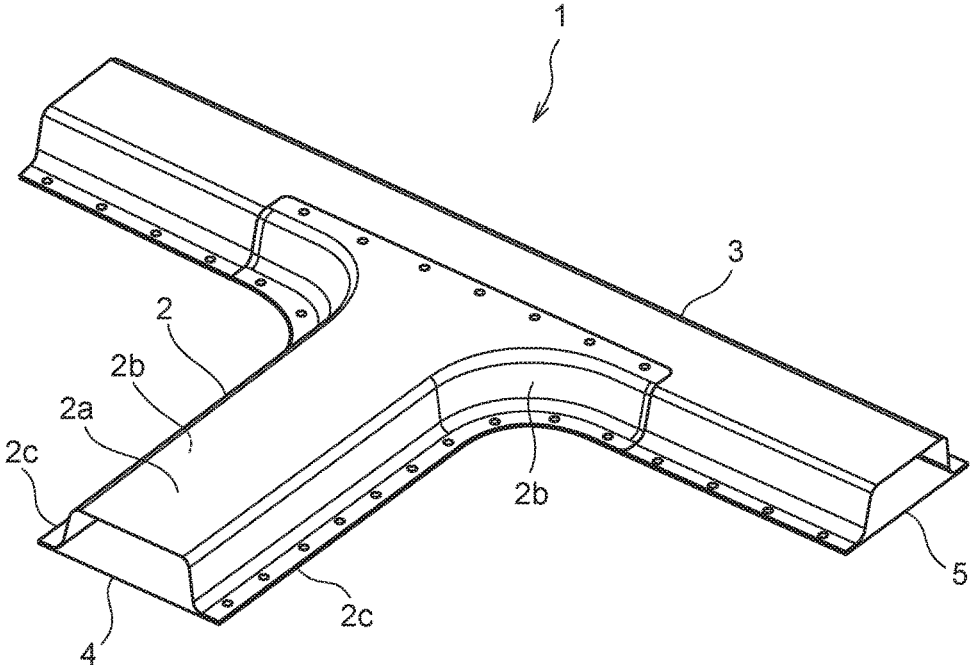
FIG. 19 is an explanatory diagram illustrating an example of a framework member formed by joining together configuration members by spot welding.
Figure 20:
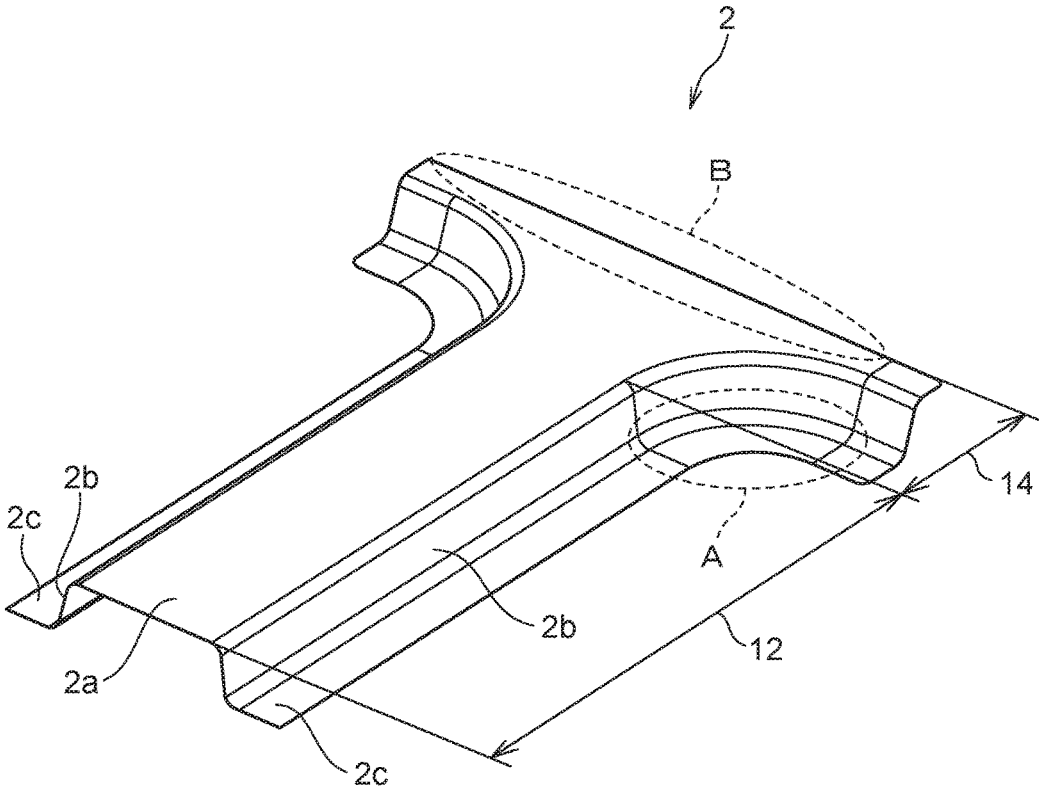
FIG. 20 is an explanatory diagram illustrating a T-shaped profile component in which a top plate has a T-shaped outer profile in plan view.

In the second exemplary embodiment, the excess portion 32 is provided to the blank 80 similarly to in the first exemplary embodiment, thereby enabling top plate edge cracking and flange edge cracking to be suppressed when forming the pressed article 70. Moreover, forming an end portion in an L-shape, as in the pressed article 70, enables a framework configuration component 90 configuring the vehicle framework component illustrated in FIG. 18 to be manufactured (FIG. 18 illustrates a framework configuration component configuring a vehicle front pillar). Simple explanation follows regarding dimensions of the framework configuration component 90 illustrated in FIG. 18.

The framework configuration component 90 has an overall length of 1150 mm, and the width of a top plate corresponding to the first formed section 21 is 130 mm. The width of a top plate at an end portion corresponding to the second formed section 22 is 340 mm, and the maximum height of the vertical walls is 75 mm. The flange width is 25 mm. Blanks for the pressed article 70 are formed from three types of high tensile sheet steel of 590 MPa grade, 980 MPa grade, and 1180 MPa grade tensile strength, and each has a sheet thickness of 1.6 mm.

Note that in the first exemplary embodiment and the second exemplary embodiment described above, the first concave portion 33, the first convex portion 34, and the second concave portion 35 of each excess portion 32 are disposed adjacent to each other in the width direction. Alternatively, straight line portions extending in straight line shapes may be present at least at one location out of between the first concave portion 33 and the first convex portion 34, or between the second concave portion 35 and the first convex portion 34. Moreover, a straight line portion extending in a straight line shape may be present between the second concave portion 35 and the first concave portion 33 of adjacent excess portions 32 in the width direction. This thereby enables the first concave portions 33, the first convex portions 34, the second concave portions 35, and third concave portions 36 to be formed as desired at the blank edge 30*a* without setting large radii of curvature in cases in which small radii of curvature would suffice for the first concave portions 33, the first convex portions 34, and the second concave portions 35.

In the first exemplary embodiment and the second exemplary embodiment, in plan view, each excess portion 32 is formed in a shape that is left-right asymmetrical about the extension line L in the width direction. Alternatively, in plan view, each excess portion 32 may be formed in a shape with left-right symmetry about the extension line L in the width direction.

In the first exemplary embodiment and the second exemplary embodiment, in plan view, the apex portion (apex) of each excess portion 32 (first convex portion 34) is set so as to be positioned on the extension line L. Alternatively, the apex portion (apex) of each excess portion 32 (first convex portion 34) may be disposed on the width direction outer side or the width direction inner side of the extension line L. Namely, the first convex portion 34 is disposed as appropriate between the inclined imaginary line AL3 and the second imaginary line AL2 according to the shape, material, and the like of the pressed article.

The disclosure of Japanese Patent Application No. 2014-100619, filed on May 14, 2014, and the disclosure of Japanese Patent Application No. 2014-203316, filed on Oct. 1, 2014, are incorporated in their entirety by reference herein.

Supplementary Explanation

A blank of the present disclosure is a blank for forming a pressed article that includes a top plate formed in an elongated shape with a length direction along a first direction and including a pair of outer edges extending along the length direction in plan view, the top plate being laid out with at least one of the outer edges curving so as to extend out toward a width direction outer side at an end portion on one length direction side of the top plate so that the one outer edge is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view. The blank includes a flat pattern edge configuring an edge on the one length direction side of the blank, and an excess portion formed at the flat pattern edge. An edge of the excess portion includes a first convex portion that protrudes toward the one length direction side of the blank with respect to the flat pattern edge, a first concave portion that is adjacent to the first convex portion at a width direction outer side of the blank, that is formed in a concave shape opening toward the one length direction side of the blank, and that connects the flat pattern edge and the first convex portion together, and a second concave portion that is adjacent to the first convex portion at a width direction inner side of the blank, that is formed in a concave shape opening toward the one length direction side of the blank, and that connects the flat pattern edge and the first convex portion together.

Configuration may preferably be made in which, in a state in which the blank has been disposed in a mold for forming the pressed article, and a bending mold for forming the vertical walls and the flanges of the pressed article is in contact with an upper face of the blank, and given that, in plan view, a curved imaginary line is defined as an imaginary line running along a curved shoulder portion of the bending mold for forming the vertical wall that is curved, a first imaginary line is defined as an imaginary line passing through a base end portion of the curved imaginary line and extending in the width direction of the blank, and a second imaginary line is defined as an imaginary line passing through a terminal end portion of the curved imaginary line and extending in the length direction of the blank, the first convex portion is disposed between the second imaginary line and an inclined imaginary line that passes through an intersection between the first imaginary line and the second imaginary line and is inclined at 22.5° toward the one length direction side of the blank with respect to the first imaginary line.

Configuration may preferably be made in which, in a state in which the blank has been disposed in the mold for forming the pressed article and the bending mold is in contact with the upper face of the blank, and given that, in plan view, an adjacent imaginary line is defined as an imaginary line running along the shoulder portion of the bending mold for forming the vertical wall and is an imaginary line adjacent to the base end portion of the curved imaginary line, the first convex portion is disposed on an extension line extended from the adjacent imaginary line toward the one length direction side of the blank.

Configuration may preferably be made in which the edge of the excess portion is formed in a shape that is left-right asymmetrical about the extension line in the width direction of the blank.

Configuration may preferably be made in which a curvature of the first concave portion is set smaller than a curvature of the second concave portion.

A pressed article manufacturing method of the present disclosure is a pressed article manufacturing method that employs pressing using cold bending to manufacture a pressed article that includes a top plate formed in an elongated shape with a length direction along a first direction and including a pair of outer edges extending along the length direction in plan view, the top plate being laid out with at least one of the outer edges curving so as to extend out toward a width direction outer side at an end portion on one length direction side of the top plate so that the one outer edge is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view. The manufacturing method includes: disposing the blank of any one of claim 1 to claim 5, or a forming sheet resulting from pre-processing the blank, between a die, and a pad and a bending mold; and, in a state in which the flat pattern edge and the edge of the excess portion are present in the same plane as a portion that will form the top plate, bending so as to press the vertical walls and the flanges of the pressed article while moving the flat pattern edge and the edge of the excess portion in-plane with respect to a location of the die corresponding to the top plate, by relatively moving either the die or the bending mold, or both the die and the bending mold, in a direction so as to approach each other in a state in which an out-of-plane deformation suppression region that is part of the portion of the blank, or of the forming sheet, that will form the top plate is being applied with pressure by the pad.

A pressed article manufacturing method of the present disclosure is a pressed article manufacturing method that employs pressing using cold bending to manufacture a pressed article that includes a top plate formed in an elongated shape with a length direction along a first direction and including a pair of outer edges extending along the length direction in plan view, the top plate being laid out with at least one of the outer edges curving so as to extend out toward a width direction outer side at an end portion on one length direction side of the top plate so that the one outer edge is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view. The manufacturing method includes: disposing the blank of any one of claim 1 to claim 5, or a forming sheet resulting from pre-processing the blank, between a die, and a pad and a bending mold; and, in a state in which the flat pattern edge and the edge of the excess portion are in the same plane as a portion that will form the top plate, bending so as to press the vertical walls and the flanges of the pressed article while moving the flat pattern edge and the edge of the excess portion in-plane with respect to a location of the die corresponding to the top plate, by placing the pad in the vicinity of, or in contact with, an out-of-plane deformation suppression region that is part of a region of the blank, or of the forming sheet, that will form the top plate, and relatively moving either the die or the bending mold, or both the die and the bending mold, in a direction so as to approach each other while maintaining a gap between the pad and the die of no less than a sheet thickness of the blank, or of the forming sheet, and no more than 1.1 times the sheet thickness of the blank, or of the forming sheet.

Moreover, configuration may preferably be made in which the breaking strength of the blank, or of the forming sheet, is from 400 MPa to 1600 MPa.

Moreover, a blank of the present disclosure is a stock material for an elongated pressed article obtained by performing pressing in which the blank or a forming sheet resulting from pre-processing the blank is bent using a pressing machine including a die, a bending mold, and a pad. The elongated pressed article has a substantially hat shaped lateral cross-section profile including a top plate that is present extending in one direction and that has a specific width in a direction intersecting the one direction, two ridge lines that are respectively linked to both edges of the top plate in a width direction that is a direction intersecting the one direction, two vertical walls that are respectively linked to the two ridge lines, and two flanges that are respectively linked to the two vertical walls. The elongated pressed article is configured by a first section in which the vertical walls are formed in flat plane shapes along the one direction, and a second section that is linked to the first section, and that includes a curved portion where the two vertical walls, and the ridge lines and the flanges that are respectively linked to the vertical walls, all curve substantially toward a sheet thickness direction of the vertical walls, and the width of the top plate gradually increases in comparison to the width of the top plate in the first section, such that the top plate exhibits a T-shape or a Y-shape in plan view. The blank has a shape in which a flat pattern of the pressed article is additionally provided with an excess portion at an edge at a location that will form the top plate in the second section, an edge of the excess portion being provided with a first concave portion, a first convex portion and a second concave portion, a third concave portion, and a second convex portion and a fourth concave portion, that satisfy the following condition 1.

Condition 1: Taking a curvature toward an inward direction of the blank as negative, and taking a curvature toward the opposite direction to the inward direction as positive, the first concave portion with negative curvature, the first convex portion with positive curvature, the second concave portion with negative curvature, the third concave portion with negative curvature, the second convex portion with positive curvature, and the fourth concave portion with negative curvature are formed in this sequence side-by-side along the edge of the excess portion.

Moreover, a blank of the present disclosure is a stock material for an elongated pressed article obtained by performing pressing in which the blank or a forming sheet resulting from pre-processing the blank is bent using a pressing machine including a die, a bending mold, and a pad. The elongated pressed article has a substantially hat shaped lateral cross-section profile including a top plate that is present extending in one direction and that has a specific width in a direction intersecting the one direction, two ridge lines that are respectively linked to both edges of the top plate in a width direction, two vertical walls that are respectively linked to the two ridge lines, and two flanges that are respectively linked to the two vertical walls. The elongated pressed article is configured by a first section in which the vertical walls are formed in flat plane shapes along the one direction, and a second section that is linked to the first section, and that includes a curved portion where one vertical wall out of the two vertical walls, and the ridge line and the flange linked to this vertical wall, all curve substantially toward a sheet thickness direction of this vertical wall, and the width of the top plate gradually increases in comparison to the width of the top plate in the first section, such that the top plate exhibits an L-shape in plan view. The blank has a shape in which a flat pattern of the pressed article is additionally provided with an excess portion at an edge at a location that will form the top plate in the second section, an edge of the excess portion being provided with a first concave portion, a convex portion, and a second concave portion that satisfy the following condition 1.

Condition 1: Taking a curvature toward an inward direction of the blank as negative, and taking a curvature toward the opposite direction to the inward direction as positive, the first concave portion with negative curvature, the convex portion with positive curvature, and the second concave portion with negative curvature are formed in this sequence side-by-side along the edge of the excess portion.

The invention claimed is:

1. A blank for forming a pressed article that includes:

a top plate formed in an elongated shape with a length direction along a first direction and including a pair of outer edges extending along the length direction in plan view, a center line between the pair of outer edges, the top plate being laid out with each of the outer edges curving so as to extend out toward a width direction outer side at an end portion on one length direction side of the top plate so that each of the outer edges is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view, the blank comprising:

a flat pattern edge configuring an edge on the one length direction side of the blank, wherein a shape of the flat pattern edge corresponds to the pressed article when opened out flat; and an excess portion provided on each of a first side of the center line and a second side of the center line, and bulging from the flat pattern edge in the length direction;

an edge of each excess portion comprising:

a first convex portion that protrudes toward the one length direction side of the blank with respect to the flat pattern edge, a first concave portion that is adjacent to the first convex portion at a width direction outer side of the blank, that is formed in a concave shape opening toward the one length direction side of the blank, and that connects the flat pattern edge and the first convex portion together, and a second concave portion that is adjacent to the first convex portion at a width direction inner side of the blank, that is formed in a concave shape opening toward the one length direction side of the blank, and that connects the flat pattern edge and the first convex portion together, wherein the flat pattern edge is provided between the second concave portion of the excess portion provided on the first side of the center line and the second concave portion of the excess portion provided on the second side of the center line, and wherein, between the excess portion on the first side of the center line and the excess portion on the second side of the center line, an inflection point from the second concave portion on the first side of the center line to the flat pattern edge and an inflection point from the second concave portion on the second side of the center line to the flat pattern edge are set apart from each other.

2. The blank of claim 1, wherein each of the first concave portion and the second concave portion is formed in an arc shape, and a curvature of the first concave portion is less than a curvature of the second concave portion.

3. A pressed article manufacturing method that employs pressing using cold bending to manufacture a pressed article that includes:

a top plate formed in an elongated shape with a length direction along a first direction and including a pair of outer edges extending along the length direction in plan view, the top plate being laid out with at least one of the outer edges curving so as to extend out toward a width direction outer side at an end portion on one length direction side of the top plate so that the one outer edge is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view, the manufacturing method comprising:

disposing the blank of claim 1, or a forming sheet resulting from pre-processing the blank, between a die, and a pad and a bending mold; and in a state in which the flat pattern edge and the edge of the excess portion are present in a same plane as a portion that will form the top plate, bending so as to press the vertical walls and the flanges of the pressed article while moving the flat pattern edge and the edge of the excess portion in-plane with respect to a location of the die corresponding to the top plate, by relatively moving either the die or the bending mold, or both the die and the bending mold, in a direction so as to approach each other in a state in which an out-of-plane deformation suppression region that is part of the portion of the blank, or of the forming sheet, that will form the top plate is being applied with pressure by the pad.

4. A pressed article manufacturing method that employs pressing using cold bending to manufacture a pressed article that includes:

a top plate formed in an elongated shape with a length direction along a first direction and including a pair of outer edges extending along the length direction in plan view, the top plate being laid out with at least one of the outer edges curving so as to extend out toward a width direction outer side at an end portion on one length direction side of the top plate so that the one outer edge is separated toward another length direction side from an edge on the one length direction side, a pair of vertical walls extending out from the pair of outer edges toward a lower side, and a pair of flanges, each extending out from a lower end portion of one of the vertical walls toward an opposite side from the top plate in plan view, the manufacturing method comprising:

disposing the blank of claim 1, or a forming sheet resulting from pre-processing the blank, between a die, and a pad and a bending mold; and in a state in which the flat pattern edge and the edge of the excess portion are in a same plane as a portion that will form the top plate, bending so as to press the vertical walls and the flanges of the pressed article while moving the flat pattern edge and the edge of the excess portion in-plane with respect to a location of the die corresponding to the top plate, by placing the pad in a vicinity of, or in contact with, an out-of-plane deformation suppression region that is part of a region of the blank, or of the forming sheet, that will form the top plate, and relatively moving either the die or the bending mold, or both the die and the bending mold, in a direction so as to approach each other while maintaining a gap between the pad and the die of no less than a sheet thickness of the blank, or of the forming sheet, and no more than 1.1 times the sheet thickness of the blank, or of the forming sheet.

5. The pressed article manufacturing method of claim 3, wherein a breaking strength of the blank, or of the forming sheet, is from 400 MPa to 1600 MPa.

6. The pressed article manufacturing method of claim 4, wherein a breaking strength of the blank, or of the forming sheet, is from 400 MPa to 1600 MPa.

* * * * *